US010038255B2

(12) United States Patent
Wu et al.

(10) Patent No.: US 10,038,255 B2
(45) Date of Patent: Jul. 31, 2018

(54) RAIL TERMINAL ASSEMBLING STRUCTURE

(71) Applicants: SWITCHLAB INC., New Taipei (TW); SWITCHLAB (SHANGHAI) CO., LTD., Shanghai (CN)

(72) Inventors: Chih-Yuan Wu, New Taipei (TW); Wei-Chi Chen, New Taipei (TW); Ming-Shan Tai, New Taipei (TW)

(73) Assignees: Switchlab Inc., New Taipei (TW); Switchlab (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 15/498,660

(22) Filed: Apr. 27, 2017

(65) Prior Publication Data

US 2018/0076540 A1 Mar. 15, 2018

(30) Foreign Application Priority Data

Sep. 13, 2016 (TW) ..... 105129737 A

(51) Int. Cl.

| | |
|---|---|
| ***H01R 4/48*** | (2006.01) |
| ***H01R 9/24*** | (2006.01) |
| ***H01R 9/26*** | (2006.01) |
| ***H01R 43/26*** | (2006.01) |

(52) U.S. Cl.

CPC ..... *H01R 9/2608* (2013.01); *H01R 4/4845* (2013.01); *H01R 9/2483* (2013.01); *H01R 43/26* (2013.01); *H01R 4/48* (2013.01)

(58) Field of Classification Search

CPC .. H01R 4/4827; H01R 4/4836; H01R 4/4845; H01R 9/26; H01R 9/2483; H01R 9/2608; H01R 4/48; H01R 4/4854

USPC ..... 439/459, 486, 817, 834, 854, 855, 858, 439/843, 845, 846, 847

See application file for complete search history.

(56) References Cited

U.S. PATENT DOCUMENTS

| | | | | |
|---|---|---|---|---|
| 6,796,855 | B2 * | 9/2004 | Fricke | H01R 4/4818 439/835 |
| 2016/0164196 | A1 * | 6/2016 | Wu | H01R 4/4818 439/816 |
| 2017/0012368 | A1 * | 1/2017 | Aboulkassem | H01R 4/4836 |

FOREIGN PATENT DOCUMENTS

| | | | | |
|---|---|---|---|---|
| EP | 0472040 | A1 * | 2/1992 | H01R 4/4818 |

* cited by examiner

*Primary Examiner* — Renee Luebke
*Assistant Examiner* — Paul Baillargeon
(74) *Attorney, Agent, or Firm* — Rosenberg, Klein & Lee

(57) ABSTRACT

A rail terminal assembling structure includes a protection member formed with an assembling passage defined by a contact side section, a connection side section and two lateral sections disposed between the connection side section and the contact side section. The assembling passage has a wire inlet having a first locating section and a second locating section. An end section of a conductive plate extends into the assembling passage and securely attached to the contact side section. A metal leaf spring has a first section, a second section and an elastic bight section connected between the first and second sections. A first located section is disposed on the first section for securely connecting with the first locating section. A second located section is disposed at the tail end of the first section for securely connecting with the second locating section.

18 Claims, 18 Drawing Sheets

RAIL TERMINAL ASSEMBLING STRUCTURE

BACKGROUND OF THE INVENTION

1. Field of the Invention

The present invention relates generally to a rail terminal assembling structure, and more particularly to a rail terminal assembling structure, which is convenient to assemble and can be securely located. In addition, the direction of the wire inlet of the rail terminal assembling structure can be adjusted in accordance with the required plug-in angle of the external conductive wire.

2. Description of the Related Art

A conventional terminal structure has an insulation case and a metal component or a metal leaf spring enclosed in the insulation case. The metal leaf spring serves to press and electrically connect with a conductive wire plugged into the terminal. The terminals are arranged and latched on a grounding rail (or conductive rail) to establish a common grounding device of an electrical apparatus or a mechanical apparatus for conducting the residual voltage or static charge of the apparatus.

FIGS. 24, 25 and 26 show a conventional terminal assembling structure currently widely applied to the above grounding rail. The terminal assembling structure mainly includes a conductive plate 7, a protection member 8 and a metal leaf spring 9, which are assembled with each other to form a conductive support structure A. An upright arm 72 is perpendicularly connected with each of two ends of the conductive plate 7 for assembling with the protection member 8, whereby the conductive plate 7 has a U-shaped cross section. In addition, a notch 71 is formed on one side of the conductive plate 7 beside each upright arm 72 near the middle section of the conductive plate 7. A shoulder section 73 is disposed on one side of a top end of the upright arm 72. The protection member 8 is fitted around the upright arm 72. The protection member 8 includes a subsidiary side 85, a first side 81, a second side 82, a third side 83 and a fourth side 84, which are sequentially perpendicularly connected with each other. An opening 86 is defined between the fourth side 84 and the subsidiary side 85, whereby the protection member 8 has a C-shaped cross section for receiving the metal leaf spring 9. At least the subsidiary side 85 serves to guide the metal leaf spring 9 to move in a fixed path. In addition, two notches 821, 841 are respectively formed beside the junctions between the third side 83 and the second and fourth sides 82, 84. The metal leaf spring 9 includes a first section 91 and a bent second section 92 connected with the first section 91. The first section 91 has a tail end 94. The second section 92 has a head end 93. In addition, two lateral protrusion sections 941, 942 are respectively formed on two sides of the first section 91. An outward protruding finger section 95 is disposed on the tail end 94.

When assembled, the protection member 8 is fitted around the upright arm 72 of the conductive plate 7. At this time, the second side 82 and the subsidiary side 85 are respectively fitted on two lateral sides of the upright arm 72 and the finger section 95 of the metal leaf spring 9 is inserted into the notch 71 of the conductive plate 7. The first section 91 is attached to the inner face of the third side 83. Then, the first section 91 and the third side 83 are connected with each other by means of a welding point 80 (as shown in FIG. 25) or a fixing member 800 (as shown in FIG. 26) or any other suitable method. Under such circumstance, the second section 92 extends toward the upright arm 72 with the head end 93 restricted by the shoulder section 73 from moving outward. Therefore, the head end 93 permits the conductive wire to easily plug into the terminal, while hindering the conductive wire from being extracted out of the terminal in a reverse direction.

However, in practice, the above structure has the following shortcomings:

1. The finger section 95 of the metal leaf spring 9 is inserted into the notch 71 so as to connect and locate the metal leaf spring 9 on the conductive plate 7. Therefore, the upright arm 72 at the end of the conductive plate 7 must extend in a direction substantially in parallel to the first section 91. (In practice, the upright arm 72 is bent to be approximately normal to the conductive plate 7). Only in this case, the simple shoulder section 73 can be used to reasonably restrict the second section 92 (the head end 93) of the metal leaf spring 9 to one-way elastically move toward the conductive plate 7. Under such circumstance, the design of the conductive plate 7 is indirectly affected. That is, the two end sections of the conductive plate 7 must be such structured as to have the bent upright arms 72. This limits the plug-in angle and direction of the external conductive wire inserted into the terminal. The conductive wire must be inserted into the protection member 8 in a direction normal to the conductive plate 7. Moreover, the conductive wire on the outer lateral side of the conductive support A must be first bent upward and then reversely bent downward so that the conductive wire can be plugged into the protection member 8 to connect with the metal leaf spring 9. This not only leads to inconvenience in working (especially the conductive wire with larger diameter is uneasy to bend), but also will occupy more room.

2. The first side 81 of the protection member 8 contacts the outer side of the upright arm 72. The finger section 95 of the metal leaf spring 9 is inserted into the notch 71. The third side 83 is connected with the metal leaf spring 9 so as to connect with the conductive plate 7. Such connection structure fails to make the protection member 8 securely connected with the conductive plate 7 and located. As shown in FIG. 26, when the conductive wire applies an outward pulling force to the metal leaf spring 9, the first section 91 of the metal leaf spring 9 will bear a counterclockwise torque centered at the finger section 95. When the counterclockwise torque exceeds the frictional force between the finger section 95 and the notch 71, the protection member 8, the metal leaf spring 9 and the conductive plate 7 are very apt to loosen and detach from each other. This affects the reliability in assembling the conductive wire with the relevant terminal.

It is therefore tried by the applicant to provide a rail terminal assembling structure to solve the above shortcomings of the conventional rail terminal assembling structure.

SUMMARY OF THE INVENTION

It is therefore a primary object of the present invention to provide a rail terminal assembling structure, in which the metal leaf spring is directly securely connected on the protection member. Then the protection member is simply connected with one end of the conductive plate. Accordingly, it is no longer necessary to interconnect the conductive plate and the metal leaf spring. In this case, relative to the conductive plate, the protection member can be designed with the characteristic that the conductive plate can be bent by different inclination angles in accordance with different required plug-in angles of the external conductive wire. Therefore, as a whole, the wiring is facilitated and the required peripheral room is reduced.

It is a further object of the present invention to provide the above rail terminal assembling structure, in which one side of a U-shaped metal leaf spring is attached to the inner surface of a preset connection side section of the protection member. In addition, the front and rear sides of the portion of the metal leaf spring in contact with the connection side section are respectively securely connected with the connection side section. The other side of the metal leaf spring has a movable end in abutment with the conductive plate. Accordingly, the protection member, the metal leaf spring and the conductive plate are securely connected with each other without easy detachment.

It is still a further object of the present invention to provide the above rail terminal assembling structure, in which it is unnecessary to additionally securely connect the metal leaf spring and the connection side section of the protection member by means of the welding point or any other fixing member. Therefore, it is very easy to assemble and process the entire rail terminal and the manufacturing cost is effectively lowered.

To achieve the above and other objects, the rail terminal assembling structure of the present invention includes: a protection member having a contact side section, a connection side section opposite to the contact side section and two lateral sections disposed between the connection side section and the contact side section, the contact side section, the connection side section and the lateral sections together defining an assembling passage passing through the protection member, the assembling passage having a wire inlet, at the junction between the connection side section and each of the two lateral sections, the wire inlet being formed with a first locating section, a second locating section being disposed at one end of the protection member distal from the first locating section; a conductive plate, one end of the conductive plate extending into the assembling passage of the protection member and securely attaching to an inner surface of the contact side section; and a metal leaf spring having a first section, a second section and an elastic bight section connected between the first and second sections, whereby the metal leaf spring is a substantially U-shaped member, two first located sections are respectively disposed on two sides of the first section of the metal leaf spring near the middle of the first section, the metal leaf spring extending into the assembling passage and attaching to the connection side section, whereby the two first located sections are snugly securely connected with the first locating sections, a second located section being disposed near or at the tail end of the first section, the second locating section being cooperatively securely connected with the second located section, whereby the metal leaf spring itself can be securely connected with the protection member, the second section of the metal leaf spring extending toward the contact side section to press the conductive plate.

In the above rail terminal assembling structure, at least one protruding elastic locating section is disposed on the connection side section of the protection member. A locating hole is formed on the first section of the metal leaf spring corresponding to the elastic locating section. The elastic locating section extends into the locating hole, whereby the first section of the metal leaf spring is securely connected with the connection side section of the protection member and located.

In the above rail terminal assembling structure, an elastic end section is disposed at the tail end of the second section of the metal leaf spring. The elastic end section is arched and bent toward the contact side section.

In the above rail terminal assembling structure, the second locating section is a stop plate bent from an edge of the connection side section toward the assembling passage. The stop plate serves to stop a tail end of the first section of the metal leaf spring.

In the above rail terminal assembling structure, the stop plate is formed with a perforation on one side near the connection side section. The tail end of the first section of the metal leaf spring is formed with an end protrusion section corresponding to the perforation. The end protrusion section is inserted in the perforation and located therein.

In the above rail terminal assembling structure, a middle portion of the stop plate is formed with an upward protruding elastic tongue section obliquely protruding toward the connection side section. A gap is reserved between the upward protruding elastic tongue section and the connection side section. The tail end of the first section of the metal leaf spring is directly inserted in the gap and located therein.

In the above rail terminal assembling structure, two lateral stop sections are respectively disposed on the two lateral sections of the protection member near an edge of the second locating section. The lateral stop sections are bent toward the assembling passage. The two lateral stop sections respectively abut against two lateral outer sides of the stop plate.

In the above rail terminal assembling structure, the second locating section is a bent plate extending into the assembling passage and bent toward the wire inlet. The bent plate serves to hold the tail end of the first section of the metal leaf spring to locate the same.

In the above rail terminal assembling structure, two lateral stop sections are respectively disposed on the two lateral sections of the protection member near an edge of the second locating section. The lateral stop sections are bent toward the assembling passage. The two lateral stop sections respectively abut against a bottom side of the bent plate.

In the above rail terminal assembling structure, the second locating section is two lateral stop sections respectively disposed on the two lateral sections of the protection member. The lateral stop sections are bent toward the assembling passage. A gap is reserved between the lateral stop sections and the connection side section. The tail end of the first section of the metal leaf spring is directly passed through the gap and located.

In the above rail terminal assembling structure, the lateral stop sections are respectively disposed on an edge of the two lateral sections of the protection member near the second locating section.

In the above rail terminal assembling structure, the second locating section is a lateral bottom section connected between the edges of the two lateral sections. The lateral bottom section is positioned on the same side as the connection side section and is lower than the connection side section, whereby a lower gap with a height difference is formed between the lateral bottom section and the connection side section. At least one protruding elastic locating section is disposed on the lateral bottom section. A locating hole is formed on the first section of the metal leaf spring corresponding to the elastic locating section, whereby after the first section is passed through the lower gap, the elastic locating section is inserted in the locating hole so that the first section of the metal leaf spring is securely connected with the connection side section and the lateral bottom section.

In the above rail terminal assembling structure, the conductive plate is respectively formed with lateral recesses near at least one lateral side of two end sections. The lateral recesses are fittable with a portion of at least one lateral section of the protection member in adjacency to the contact side section and tightly connected therewith, whereby the protection member is located and hindered from moving in an axial direction of the conductive plate.

The present invention can be best understood through the following description and accompanying drawings, wherein:

DETAILED DESCRIPTION OF THE PREFERRED EMBODIMENTS

Figure 1:
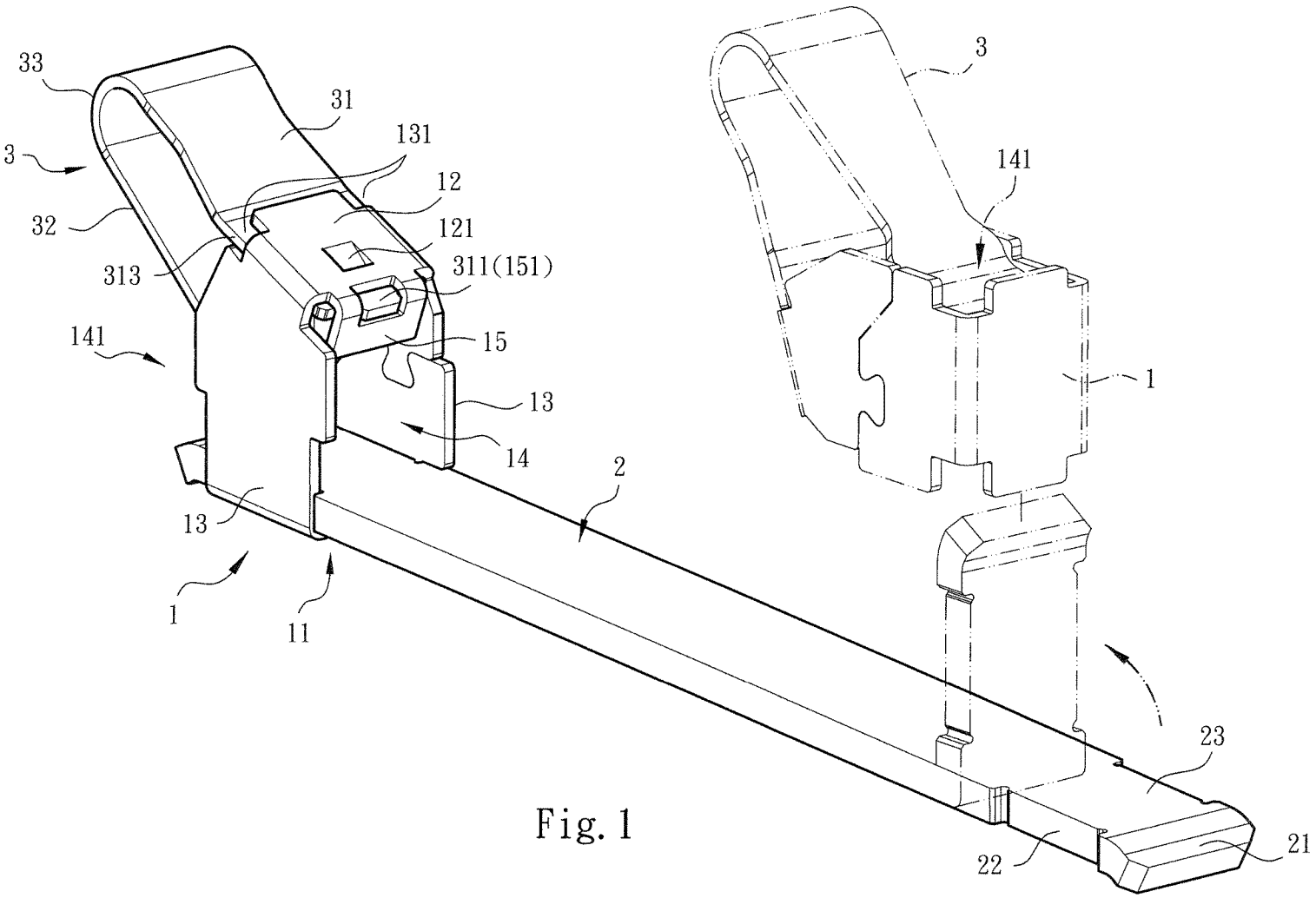
FIG. 1 is a perspective assembled view of a first embodiment of the present invention.
Figure 2:
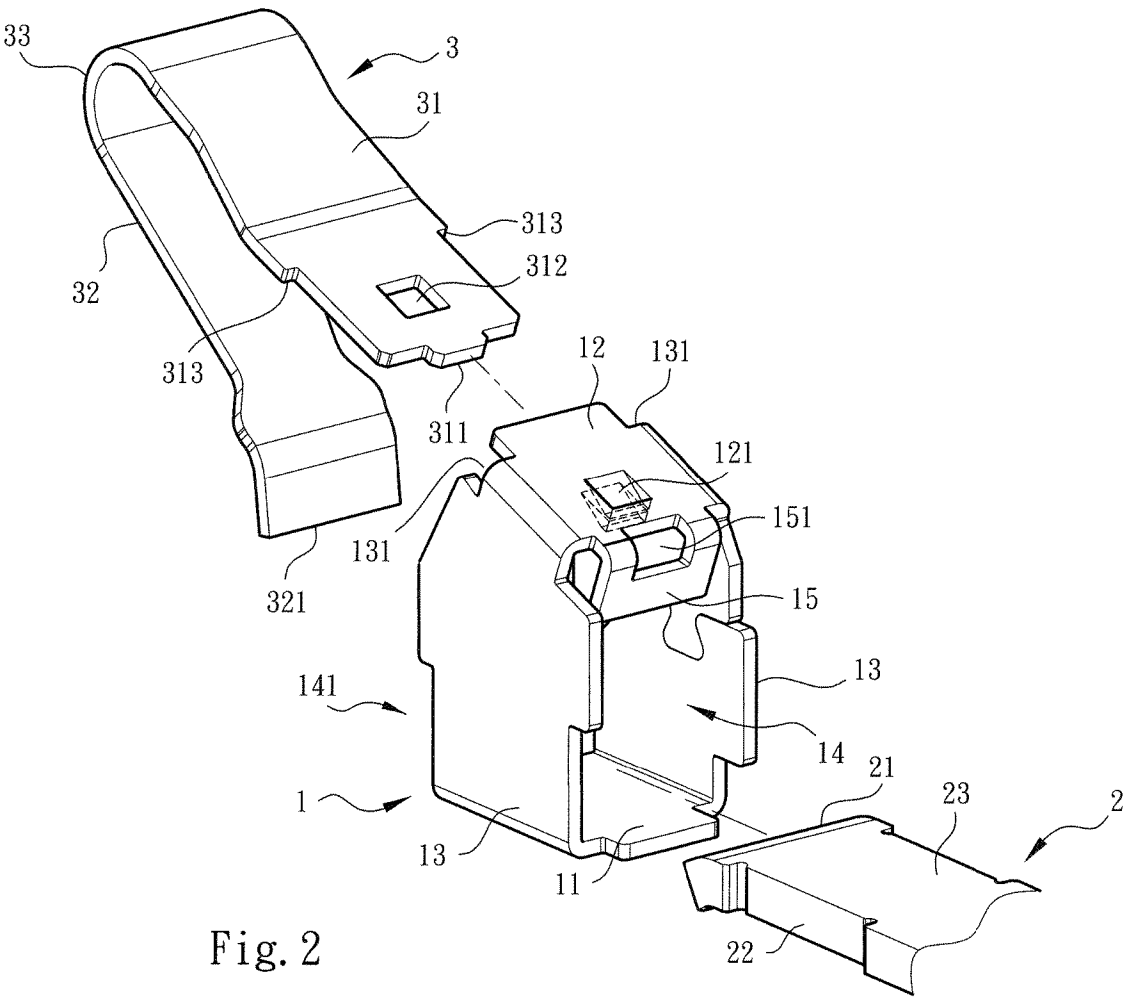
FIG. 2 is a perspective exploded view of the first embodiment of the present invention.

Please refer to FIGS. 1 to 4. According to a first embodiment, the rail terminal assembling structure of the present invention includes a protection member 1, a conductive plate 2 and a metal leaf spring 3. The protection member 1 has a contact side section 11 and a connection side section 12 opposite to each other. Two lateral sections 13 are respectively disposed on two sides of the connection side section 12. The lateral sections 13 extend from the two sides of the connection side section 12 to connect with two sides of the contact side section 11 so as to define an assembling passage 14 passing through the protection member 1. One end of the assembling passage 14 is a wire inlet 141. At the junction between the connection side section 12 and each of the two lateral sections 13, the wire inlet 141 is formed with a first locating section 131, (such as a lateral notch). In addition, a second locating section 15 is disposed at one end of the protection member 1 distal from the first locating sections 131. Moreover, at least one elastic locating section 121 is disposed on the connection side section 12. The elastic locating section 121 protrudes toward the assembling passage 14.

In a preferred embodiment, the second locating section 15 is a stop plate downward bent from an edge of the connection side section 12 toward the assembling passage 14. A perforation 151 is formed on one side of the stop plate proximal to the connection side section 12. The elastic locating section 121 is a protruding elastic locating tongue section formed by means of punching.

One end of the conductive plate 2 extends into the assembling passage 14 of the protection member 1 and is securely attached to an inner surface of the contact side section 11. In a preferred embodiment, the conductive plate 2 is respectively formed with lateral recesses 22 near two lateral sides of two end sections. The lateral recesses 22 can be fitted with the portions of the two lateral sections 13 of the protection member 1 in adjacency to the contact side section 11 with the conductive plate 2 attached to the inner side of the contact side section 11. Accordingly, the protection member 1 is located and hindered from moving in the axial direction of the conductive plate 2. The conductive plate 2 has an inner face 23 distal from the contact side section 11. In addition, two end sections of the conductive plate 2 are respectively formed with arched edges 21 bent and extending in a direction away from the assembling passage 14.

In practice, the conductive plate 2 not only can be secured by means of fitting the lateral recesses 22 with the protection member 1, but also can be securely connected with the protection member 1 by means of other suitable structures and manners. In this case, the conductive plate 2 can be better multidirectionally located.

The metal leaf spring 3 has a first section 31, a second section 32 and an elastic bight section 33 connected between the first and second sections 31, 32. Accordingly, the metal leaf spring 3 is a substantially U-shaped member. Two first located sections 313 are respectively disposed on two sides of the first section 31 of the metal leaf spring 3 near the middle of the first section 31, (such as outward expanded lateral protrusion sections). The first section 31 is formed with a locating hole 312 corresponding to the elastic locating section 121.

In a preferred embodiment, a second located section 311 (such as an end protrusion section) is disposed at a tail end of the first section 31 of the metal leaf spring 3. An elastic end section 321 is disposed at a tail end of the second section 32. The elastic end section 321 is arched and bent toward the contact side section 11.

When assembled, after the conductive plate 2 is connected with the protection member 1, the metal leaf spring 3 is extended into the assembling passage 14 with the first section 31 attached to the connection side section 12. The second locating section 15 (the stop plate) serves to stop the tail end of the first section 31 of the metal leaf spring 3. At this time, the second located section 311 is inserted into the perforation 151, while the elastic locating section 121 (elastic locating tongue section) extends into the locating hole 312. Also, the two first located sections 313 are respectively snugly securely engaged with the two first locating sections 131. Accordingly, the first section 31 of the metal leaf spring 3 is securely connected with the connection side section 12 of the protection member 1 to effectively locate the metal leaf spring 3. Also, the elastic end section 321 of the second section 32 of the metal leaf spring 3 abuts against the inner face 23 of the conductive plate 2.

In use, the external conductive wire A extends into the assembling passage 14 from one side near the first locating section 131. At this time, the conductive wire A first pushes the second section 32 of the metal leaf spring 3 to elastically compress and deform the elastic bight section 33. After the conductive wire A passes through the elastic end section 321, under the elastic restoring force of the elastic bight section 33, the elastic end section 321 of the second section 32 cooperates with the inner face 23 of the conductive plate 2 to together hold the conductive wire A and electrically connect therewith. In the case that the conductive wire A is pulled by an external force, the conductive wire A will drive the second section 32 to move in reverse direction. Under such circumstance, the second section 32 will gradually move toward the conductive wire A and fasten the conductive wire A to effectively hinder the conductive wire A from being loosened and extracted out.

Figure 4:
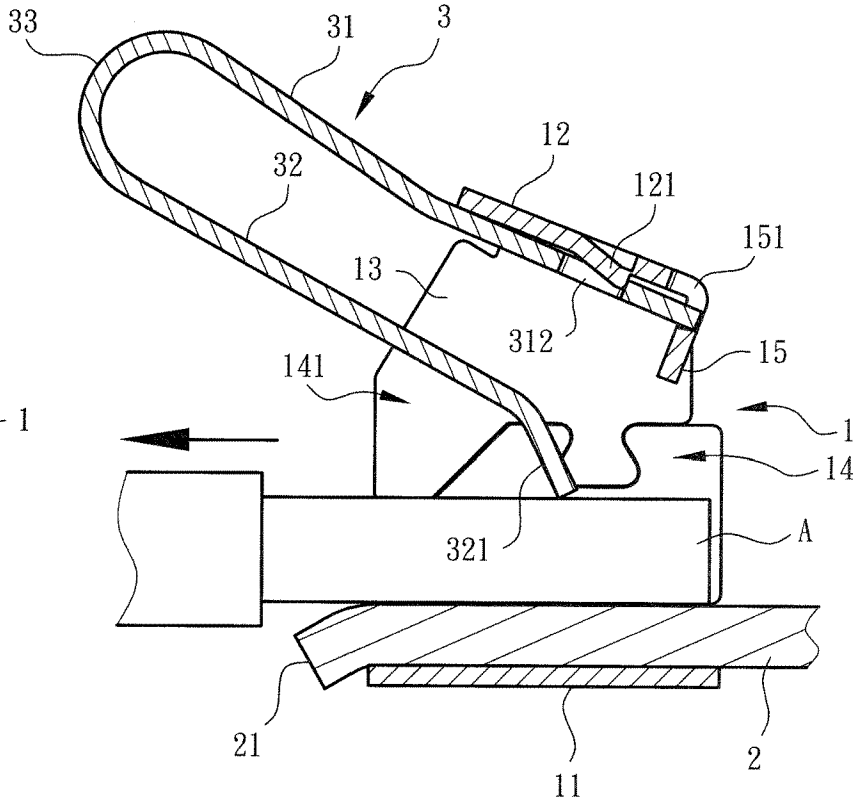
FIG. 4 is a sectional view according to FIG. 3, showing that the external conductive wire is fastened by the metal leaf spring and hindered from being extracted out of the terminal.
Figure 3:
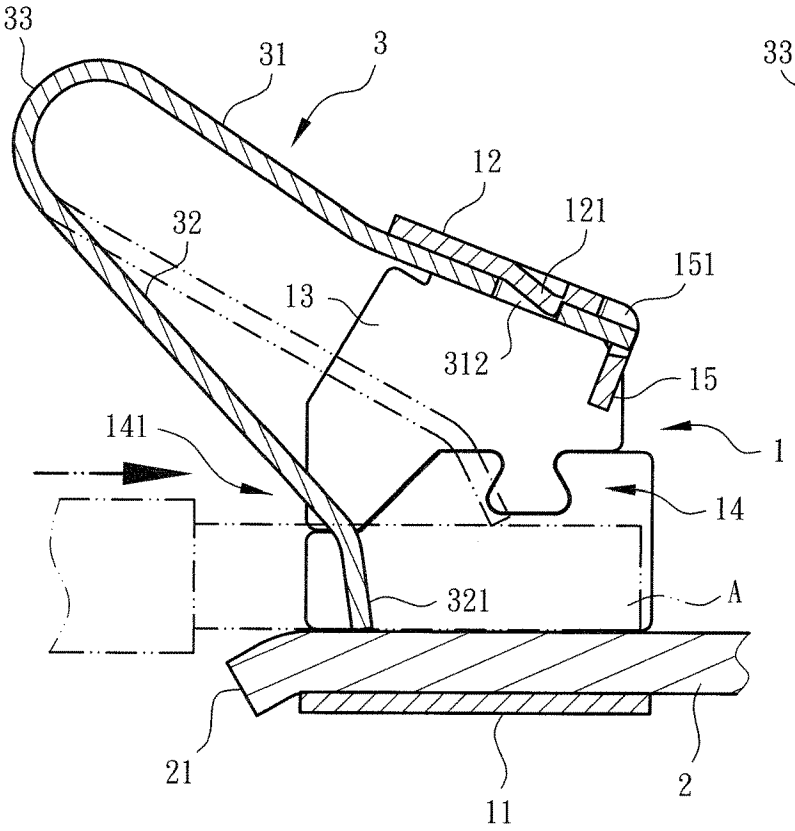
FIG. 3 is an operational sectional view of the first embodiment of the present invention, showing that the external conductive wire is plugged into the terminal to push the metal leaf spring.

In the above structure of this embodiment, the first locating sections 131, the elastic locating section 121 (the elastic locating tongue section) and the perforation 151 of the second locating section 15 are connected with the first located sections 313, the locating hole 312 and the second located section 311. Accordingly, the first section 31 of the metal leaf spring 3 is located with the connection side section 12 of the protection member 1 at multiple portions. As shown in FIG. 4, when the conductive wire A is pulled by the external force, the first section 31 of the metal leaf spring 3 bears a clockwise torque. At this time, by means of the design that the second locating section 15 (such as the perforation 151) is fitted with the second located section 311, the force applied by the locating hole 312 to the elastic locating section 121 is effectively reduced. Therefore, the possibility of deformation of the elastic locating section 121 due to the force is minified. In this case, the conductive wire A can be more securely assembled with the terminal without easy loosening and detachment.

Figure 5:
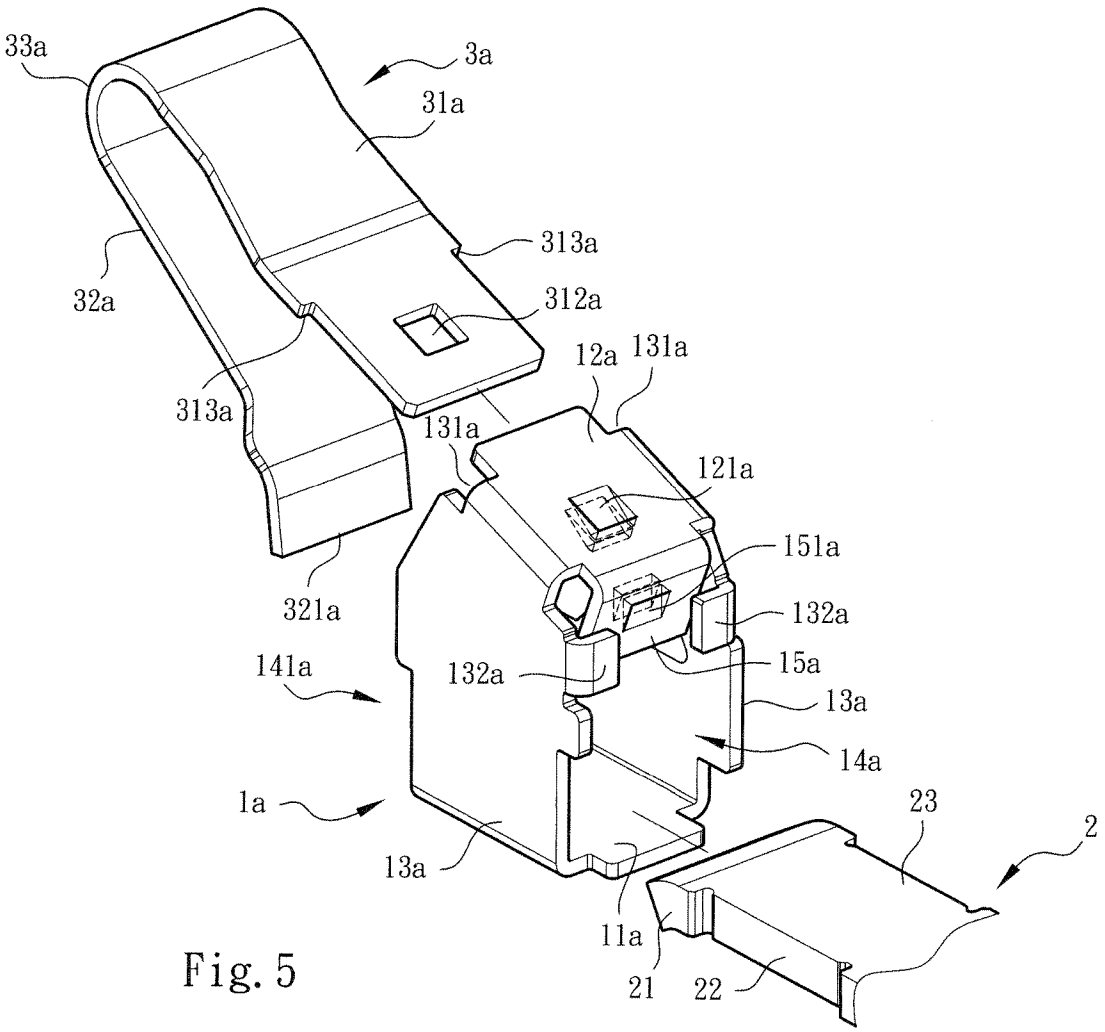
FIG. 5 is a perspective exploded view of a second embodiment of the present invention.
Figure 7:
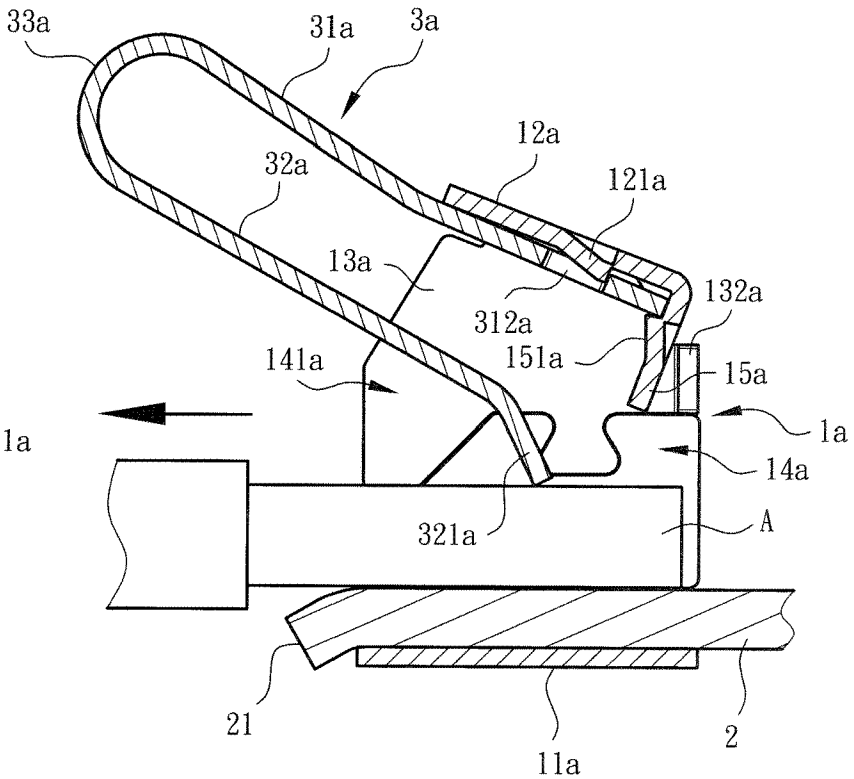
FIG. 7 is a sectional view according to FIG. 6, showing that the external conductive wire is fastened by the metal leaf spring and hindered from being extracted out of the terminal.
Figure 6:
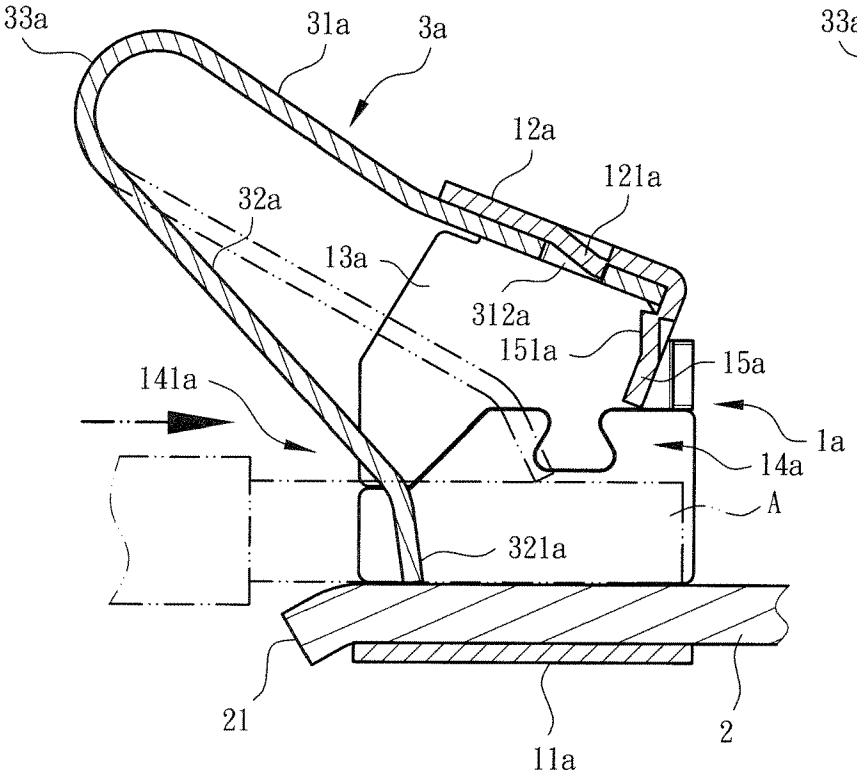
FIG. 6 is an operational sectional view of the second embodiment of the present invention, showing that the external conductive wire is plugged into the terminal to push the metal leaf spring.

Please now refer to FIGS. 5 to 7. According to a second embodiment, the rail terminal assembling structure of the present invention includes a protection member 1*a*, a metal leaf spring 3*a* and a conductive plate 2 identical to the conductive plate of the first embodiment. The protection member 1*a* has a contact side section 11*a* and a connection side section 12*a* opposite to each other. Two lateral sections 13*a* are respectively disposed on two sides of the connection side section 12*a*. The lateral sections 13*a* extend from the two sides of the connection side section 12*a* to connect with two sides of the contact side section 11*a* so as to define an assembling passage 14*a* passing through the protection member 1*a*. One end of the assembling passage 14*a* is a wire inlet 141*a*. A first locating section 131*a*, (such as a lateral notch) is formed at the junction between the connection side section 12*a* and each of the two lateral sections 13*a*. In addition, a second locating section 15*a* is disposed on one side of the protection member 1*a* distal from the first locating sections 131*a*. Moreover, an elastic locating section 121*a* is disposed on the connection side section 12*a*. The elastic locating section 121*a* protrudes toward the assembling passage 14*a*.

In a preferred embodiment, the second locating section 15*a* is a stop plate downward bent from an edge of the connection side section 12*a* toward the assembling passage 14*a*. A middle section of the stop plate is punched to form an upward protruding elastic tongue section 151*a* obliquely protruding toward the connection side section 12*a*. A gap is reserved between the upward protruding elastic tongue section 151*a* and the connection side section 12*a*. The elastic locating section 121*a* is a protruding elastic locating tongue section formed by means of punching. In addition, two lateral stop sections 132*a* are respectively disposed on the two lateral sections 13*a* near an edge of the second locating section 15*a* (the stop plate). The lateral stop sections 132*a* are bent toward the assembling passage 14*a*. The two lateral stop sections 132*a* respectively abut against two lateral outer sides of the second locating section 15*a* (the stop plate).

The conductive plate 2 is securely assembled and connected on the inner surface of the contact side section 11*a* of the protection member 1*a* in the same manner as the first embodiment.

The metal leaf spring 3*a* has a first section 31*a*, a second section 32*a* and an elastic bight section 33*a* connected between the first and second sections 31*a*, 32*a*. Accordingly, the metal leaf spring 3*a* is a substantially U-shaped member.

Two outward expanded first located sections 313*a* are respectively disposed on two sides of the first section 31*a* of the metal leaf spring 3*a* near the middle of the first section 31*a*, (such as lateral protrusion sections). The first section 31*a* is formed with a locating hole 312*a* corresponding to the elastic locating section 121*a*. An elastic end section 321*a* is disposed at a tail end of the second section 32*a*. The elastic end section 321*a* is arched and bent toward the contact side section 11*a*.

When assembled, after the conductive plate 2 is connected with the protection member 1*a*, the metal leaf spring 3*a* is extended into the assembling passage 14*a* with the first section 31*a* attached to the connection side section 12*a*. The second locating section 15*a* (the stop plate) serves to stop the tail end of the first section 31*a* of the metal leaf spring 3*a*. The tail end of the first section 31*a* is directly inserted into the gap between the upward protruding elastic tongue section 151*a* and the connection side section 12*a*. In addition, the elastic locating section 121*a* (the elastic locating tongue section) is cooperatively extended into the locating hole 312*a*. The two first located sections 313*a* (the lateral protrusion sections) are respectively located in the two first locating sections 131*a* (the lateral notches). Accordingly, the first section 31*a* of the metal leaf spring 3*a* is securely connected with the connection side section 12*a* of the protection member 1*a* to locate the metal leaf spring 3*a*. Also, the elastic end section 321*a* of the second section 32*a* of the metal leaf spring 3*a* abuts against the inner face 23 of the conductive plate 2.

In use, the external conductive wire A extends into the assembling passage 14*a* from one side near the first locating section 131*a* (the lateral notch). At this time, the conductive wire A first pushes the second section 32*a* of the metal leaf spring 3*a* to elastically compress and deform the elastic bight section 33*a*. After the conductive wire A passes through the elastic end section 321*a*, under the elastic restoring force of the elastic bight section 33*a*, the elastic end section 321*a* of the second section 32*a* cooperates with the inner face 23 of the conductive plate 2 to together hold the conductive wire A and electrically connect therewith. In the case that the conductive wire A is pulled by an external force, the conductive wire A will drive the second section 32*a* to move in reverse direction. Under such circumstance, the second section 32*a* will gradually move toward the conductive wire A and fasten the conductive wire A to effectively hinder the conductive wire A from being loosened and extracted out.

Figure 8:
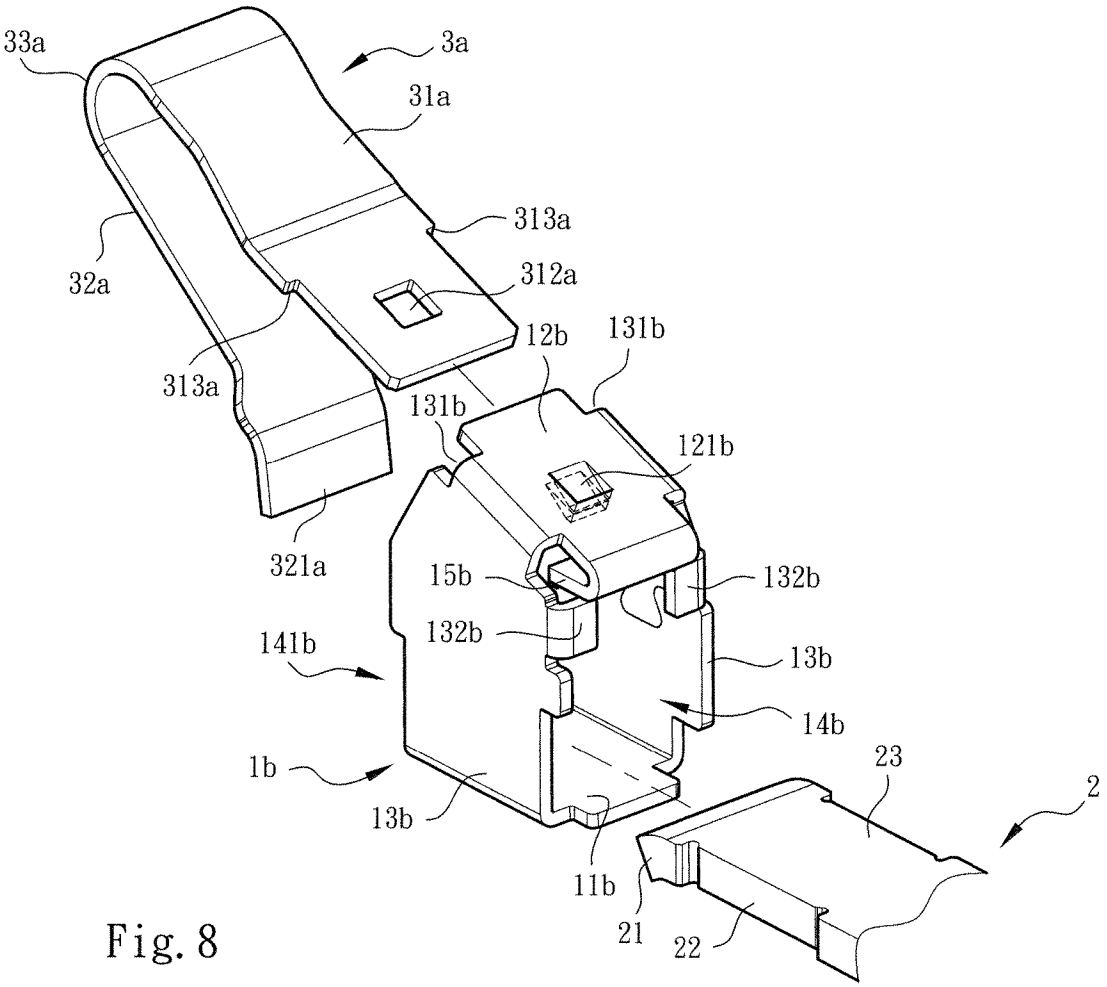
FIG. 8 is a perspective exploded view of a third embodiment of the present invention.
Figure 10:
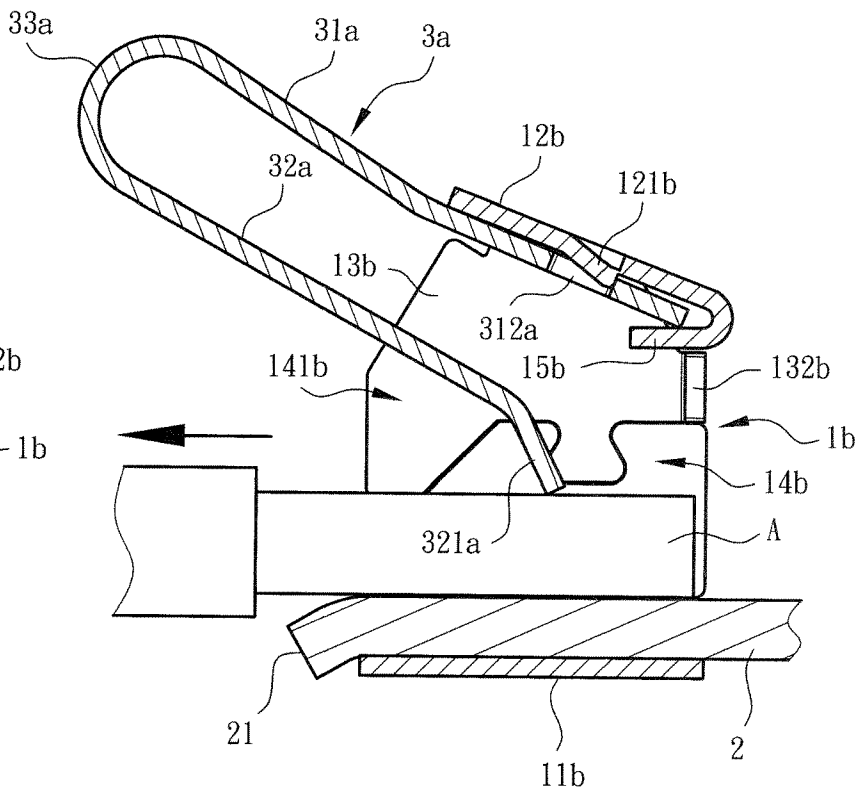
FIG. 10 is a sectional view according to FIG. 9, showing that the external conductive wire is fastened by the metal leaf spring and hindered from being extracted out of the terminal.
Figure 9:
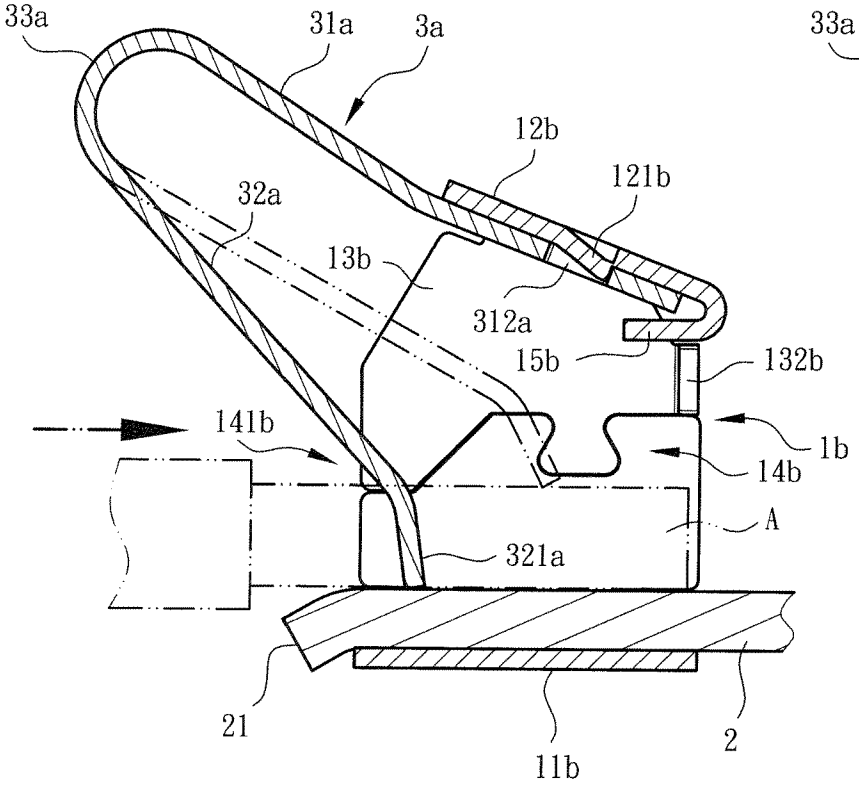
FIG. 9 is an operational sectional view of the third embodiment of the present invention, showing that the external conductive wire is plugged into the terminal to push the metal leaf spring.

Please now refer to FIGS. 8 to 10. According to a third embodiment, the rail terminal assembling structure of the present invention includes a protection member 1*b* and a conductive plate 2 and metal leaf spring 3*a* identical to the conductive plate and metal leaf spring of the second embodiment. The protection member 1*b* has a contact side section 11*b* and a connection side section 12*b* opposite to each other. Two lateral sections 13*b* are respectively disposed on two sides of the connection side section 12*b*. The lateral sections 13*b* extend from the two sides of the connection side section 12*b* to connect with two sides of the contact side section 11*b* so as to define an assembling passage 14*b* passing through the protection member 1*b*. One end of the assembling passage 14*b* is a wire inlet 141*b*. A first locating section 131*b*, (such as a lateral notch) is formed at the junction between the connection side section 12*b* and each of the two lateral sections 13*b*. In addition, a second locating section 15*b* is disposed on one side of the protection member 1*b* distal from the first locating sections 131*b* (the lateral notch).

Moreover, an elastic locating section 121*b* is disposed on the connection side section 12*b*. The elastic locating section 121*b* protrudes toward the assembling passage 14*b*.

In a preferred embodiment, the second locating section 15*b* is a bent plate extending into the assembling passage 14*b* and bent toward the first locating sections 131*b* (the lateral notch). In addition, two lateral stop sections 132*b* are respectively disposed on the two lateral sections 13*b* near an edge of the second locating section 15*b* (the bent plate). The lateral stop sections 132*b* are bent toward the assembling passage 14*b*. The two lateral stop sections 132*b* respectively abut against the bottom side of the second locating section 15*b* (the bent plate).

The conductive plate 2 is securely assembled and connected on the inner surface of the contact side section 11*b* of the protection member 1*b* in the same manner as the first embodiment.

When assembled, after the conductive plate 2 is connected with the protection member 1*b*, the metal leaf spring 3*a* is extended into the assembling passage 14*b* with the first section 31*a* attached to the connection side section 12*b*. The second locating section 15*b* (the bent plate) serves to hold the tail end of the first section 31*a* of the metal leaf spring 3*a*. In addition, the elastic locating section 121*b* (the elastic locating tongue section) is cooperatively extended into the locating hole 312*a*. The two first located sections 313*a* (the lateral protrusion sections) are respectively inserted in the two first locating sections 131*b* (the lateral notches). Accordingly, the first section 31*a* of the metal leaf spring 3*a* is securely connected with the connection side section 12*b* of the protection member 1*b* to locate the metal leaf spring 3*a*. Also, the elastic end section 321*a* of the second section 32*a* of the metal leaf spring 3*a* abuts against the inner face 23 of the conductive plate 2.

In use, the external conductive wire A extends into the assembling passage 14*b* from one side near the first locating section 131*b* (the lateral notch). At this time, the conductive wire A first pushes the second section 32*a* of the metal leaf spring 3*a* to elastically compress and deform the elastic bight section 33*a*. After the conductive wire A passes through the elastic end section 321*a*, under the elastic restoring force of the elastic bight section 33*a*, the elastic end section 321*a* of the second section 32*a* cooperates with the inner face 23 of the conductive plate 2 to together hold the conductive wire A and electrically connect therewith. In the case that the conductive wire A is pulled by an external force, the conductive wire A will drive the second section 32*a* to move in reverse direction. Under such circumstance, the second section 32*a* will gradually move toward the conductive wire A and fasten the conductive wire A to effectively hinder the conductive wire A from being loosened and extracted out.

Figure 11:
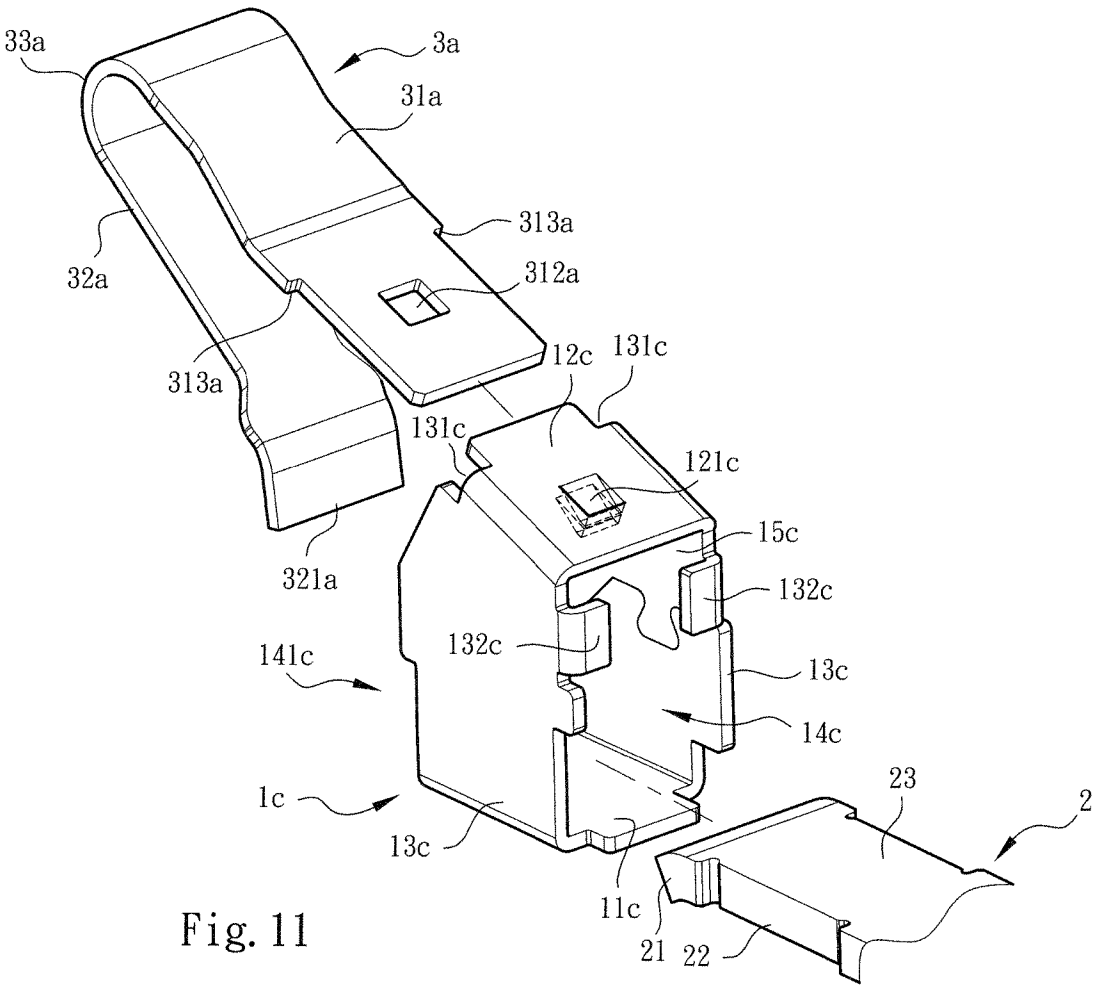
FIG. 11 is a perspective exploded view of a fourth embodiment of the present invention.
Figure 13:
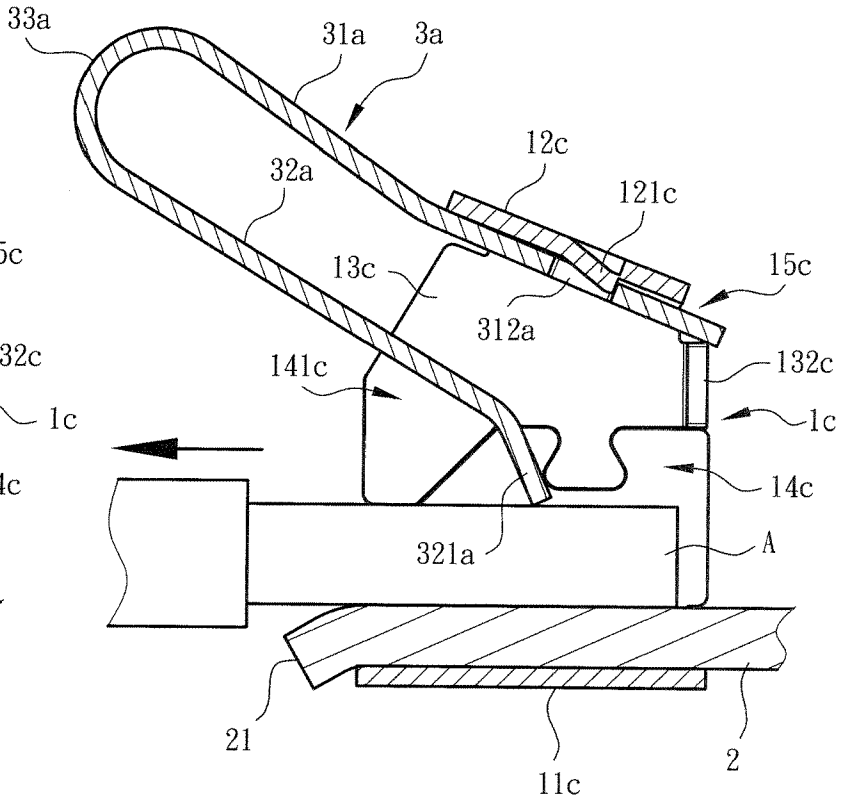
FIG. 13 is a sectional view according to FIG. 12, showing that the external conductive wire is fastened by the metal leaf spring and hindered from being extracted out of the terminal.
Figure 12:
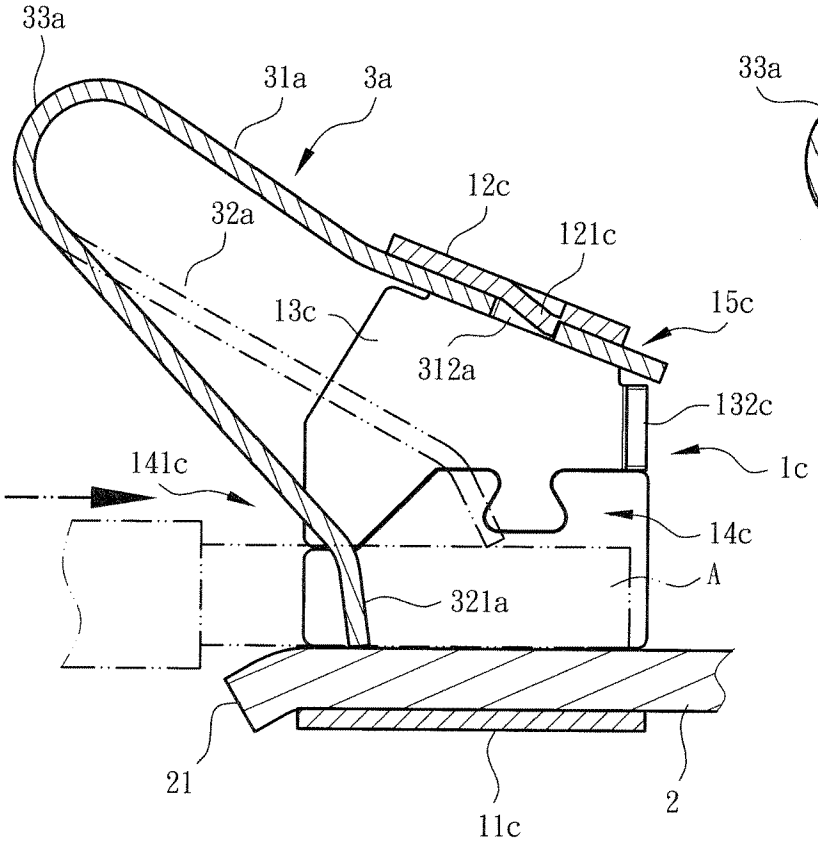
FIG. 12 is an operational sectional view of the fourth embodiment of the present invention, showing that the external conductive wire is plugged into the terminal to push the metal leaf spring.

Please now refer to FIGS. 11 to 13. According to a fourth embodiment, the rail terminal assembling structure of the present invention includes a protection member 1*c* and a conductive plate 2 and metal leaf spring 3*a* identical to the conductive plate and metal leaf spring of the second embodiment. The protection member 1*c* has a contact side section 11*c* and a connection side section 12*c* opposite to each other. Two lateral sections 13*c* are respectively disposed on two sides of the connection side section 12*c*. The lateral sections 13*c* extend from the two sides of the connection side section 12*c* to connect with two sides of the contact side section 11*c* so as to define an assembling passage 14*c* passing through the protection member 1*c*. One end of the assembling passage 14*c* is a wire inlet 141*c*. A first locating section 131*c*, (such as a lateral notch) is formed at the junction between the connection side section 12*c* and each of the two lateral sections 13*c*. In addition, two second locating sections 132*c* are disposed at one end of the protection member 1*c* distal from the first locating sections 131*c* (the lateral notch). Moreover, an elastic locating section 121*c* is disposed on the connection side section 12*c*. The elastic locating section 121*c* protrudes toward the assembling passage 14*c*.

In a preferred embodiment, the second locating sections 132*c* are two lateral stop sections respectively disposed on an edge of each of the two lateral sections 13*c* distal from the first locating section 131*c* (the lateral notch). The lateral stop sections are bent toward the assembling passage 14*c*. In addition, a gap 15*c* is reserved between the second locating sections 132*c* (the lateral stop sections) and the connection side section 12*c*.

The conductive plate 2 is securely assembled and connected on the inner surface of the contact side section 11*c* of the protection member 1*c* in the same manner as the first embodiment.

When assembled, after the conductive plate 2 is connected with the protection member 1*c*, the metal leaf spring 3*a* is extended into the assembling passage 14*c* with the first section 31*a* attached to the connection side section 12*c*. The tail end of the first section 31*a* is directly passed through the gap 15*c* and the elastic locating section 121*c* (the elastic locating tongue section) is cooperatively extended into the locating hole 312*a*. The two first located sections 313*a* (the lateral protrusion sections) are respectively engaged in the two first locating sections 131*c* (the lateral notches). Accordingly, the first section 31*a* of the metal leaf spring 3*a* is securely connected with the connection side section 12*c* of the protection member 1*c* to locate the metal leaf spring 3*a*. Also, the elastic end section 321*a* of the second section 32*a* of the metal leaf spring 3*a* abuts against the inner face 23 of the conductive plate 2.

In use, the external conductive wire A extends into the assembling passage 14*c* from one side near the first locating section 131*c* (the lateral notch). At this time, the conductive wire A first pushes the second section 32*a* of the metal leaf spring 3*a* to elastically compress and deform the elastic bight section 33*a*. After the conductive wire A passes through the elastic end section 321*a*, under the elastic restoring force of the elastic bight section 33*a*, the elastic end section 321*a* of the second section 32*a* cooperates with the inner face 23 of the conductive plate 2 to together hold the conductive wire A and electrically connect therewith. In the case that the conductive wire A is pulled by an external force, the conductive wire A will drive the second section 32*a* to move in reverse direction. Under such circumstance, the second section 32*a* will gradually move toward the conductive wire A and fasten the conductive wire A to effectively hinder the conductive wire A from being loosened and extracted out.

Figure 14:
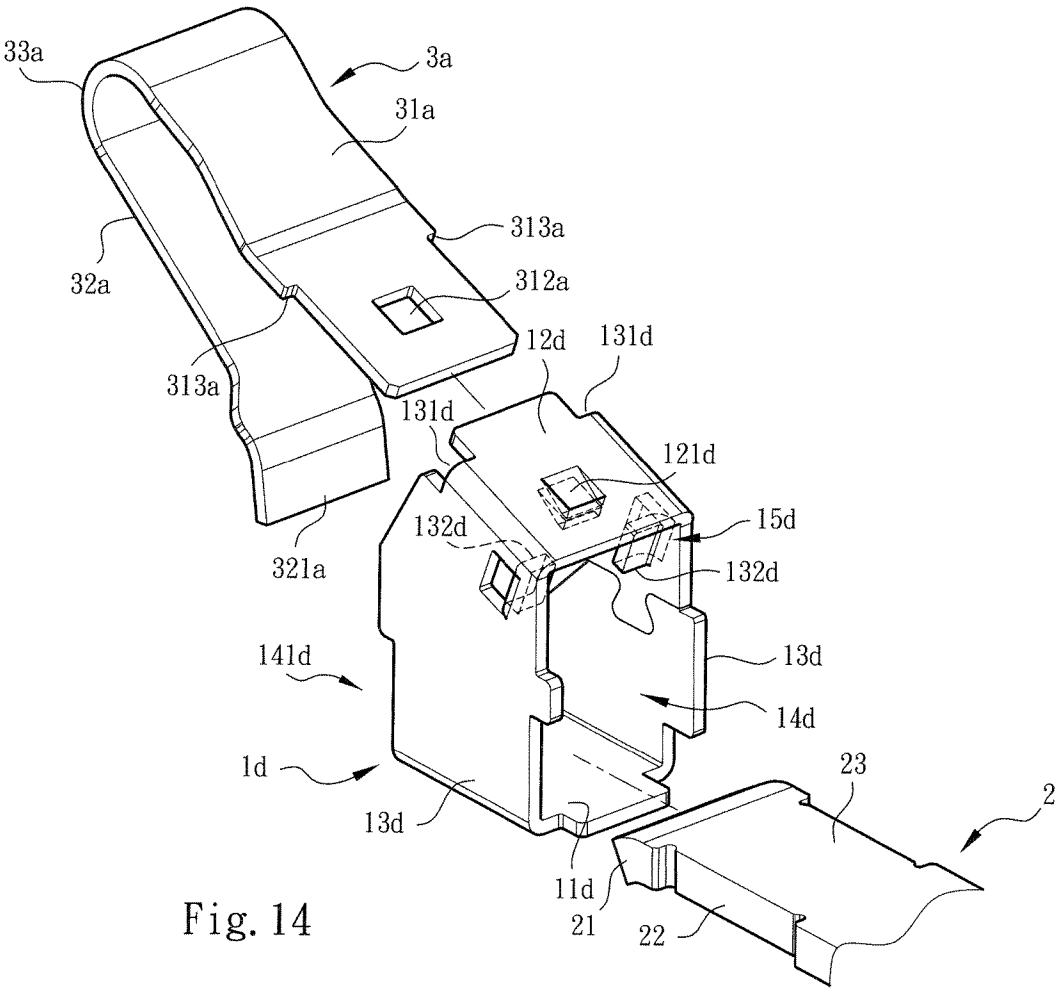
FIG. 14 is a perspective exploded view of a fifth embodiment of the present invention.
Figure 16:
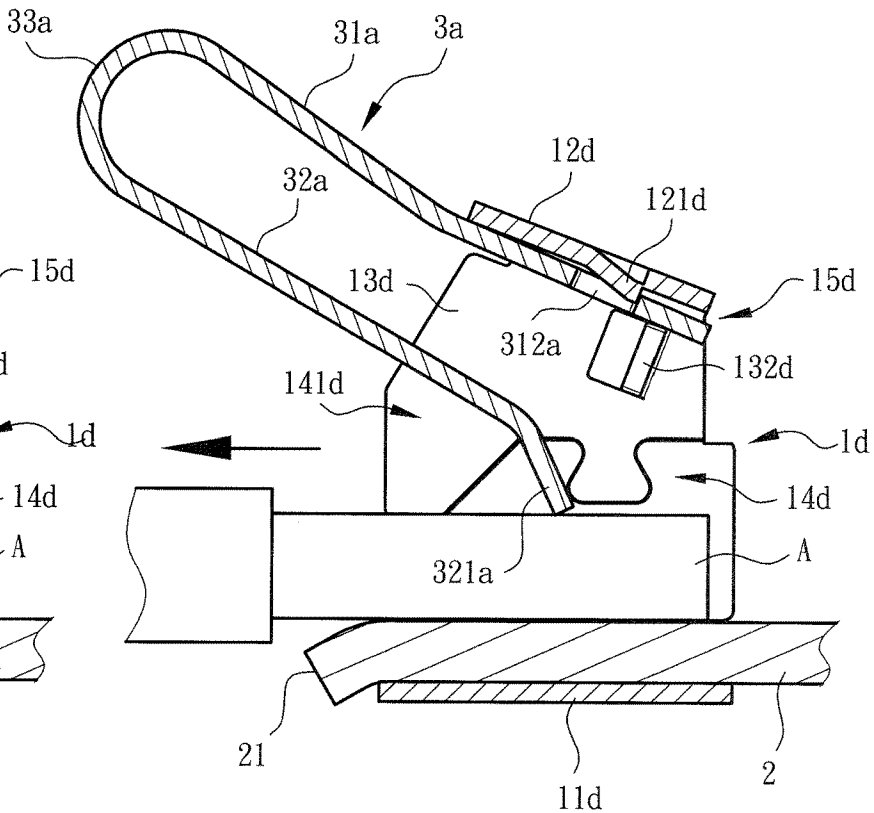
FIG. 16 is a sectional view according to FIG. 15, showing that the external conductive wire is fastened by the metal leaf spring and hindered from being extracted out of the terminal.
Figure 15:
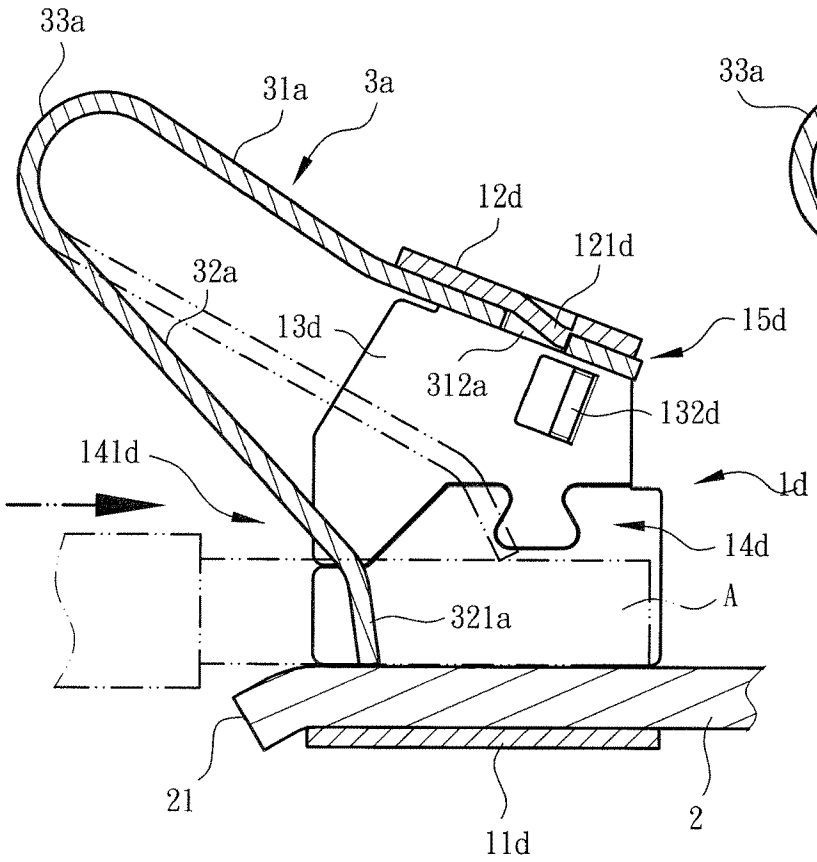
FIG. 15 is an operational sectional view of the fifth embodiment of the present invention, showing that the external conductive wire is plugged into the terminal to push the metal leaf spring.

Please now refer to FIGS. 14 to 16. According to a fifth embodiment, the rail terminal assembling structure of the present invention includes a protection member 1*d* and a conductive plate 2 and metal leaf spring 3*a* identical to the conductive plate and metal leaf spring of the second embodiment. The protection member 1*d* has a contact side section 11*d* and a connection side section 12*d* opposite to each other. Two lateral sections 13*d* are respectively disposed on two sides of the connection side section 12*d*. The lateral sections 13*d* extend from the two sides of the connection side section 12*d* to connect with two sides of the contact side section 11*d* so as to define an assembling passage 14*d* passing through the protection member 1*d*. One end of the assembling passage 14*d* is a wire inlet 141*d*. A first locating section 131*d*, (such as a lateral notch) is formed at the junction between the connection side section 12*d* and each of the two lateral sections 13*d*. In addition, two second locating sections 132*d* are disposed on one side of the protection member 1*d* distal from the first locating sections 131*d* (the lateral notch). Moreover, an elastic locating section 121*d* is disposed on the connection side section 12*d*. The elastic locating section 121*d* protrudes toward the assembling passage 14*d*.

In a preferred embodiment, the second locating sections 132*d* are two lateral stop sections respectively disposed on the middles of the lateral sections 13*d*. The lateral stop sections are transversely bent toward the assembling passage 14*d*. In addition, a gap 15*d* is reserved between the second locating sections 132*d* (the lateral stop sections) and the connection side section 12*d*.

The conductive plate 2 is securely assembled and connected on the inner surface of the contact side section 11*d* of the protection member 1*d* in the same manner as the first embodiment.

When assembled, after the conductive plate 2 is connected with the protection member 1*d*, the metal leaf spring 3*a* is extended into the assembling passage 14*c* with the first section 31*a* attached to the connection side section 12*d*. The end face of the first section 31*a* is directly passed through the gap 15*d* and the elastic locating section 121*d* (the elastic locating tongue section) is cooperatively extended into the locating hole 312*a*. The two first located sections 313*a* (the lateral protrusion sections) are respectively engaged in the two first locating sections 131*d* (the lateral notches). Accordingly, the first section 31*a* of the metal leaf spring 3*a* is securely connected with the connection side section 12*d* of the protection member 1*d* to locate the metal leaf spring 3*a*. Also, the elastic end section 321*a* of the second section 32*a* of the metal leaf spring 3*a* abuts against the inner face 23 of the conductive plate 2.

In use, the external conductive wire A extends into the assembling passage 14*d* from one side near the first locating section 131*d* (the lateral notch). At this time, the conductive wire A first pushes the second section 32*a* of the metal leaf spring 3*a* to elastically compress and deform the elastic bight section 33*a*. After the conductive wire A passes through the elastic end section 321*a*, under the elastic restoring force of the elastic bight section 33*a*, the elastic end section 321*a* of the second section 32*a* cooperates with the inner face 23 of the conductive plate 2 to together hold the conductive wire A and electrically connect therewith. In the case that the conductive wire A is pulled by an external force, the conductive wire A will drive the second section 32*a* to move in reverse direction. Under such circumstance, the second section 32*a* will gradually move toward the conductive wire A and fasten the conductive wire A to effectively hinder the conductive wire A from being loosened and extracted out.

Figure 17:
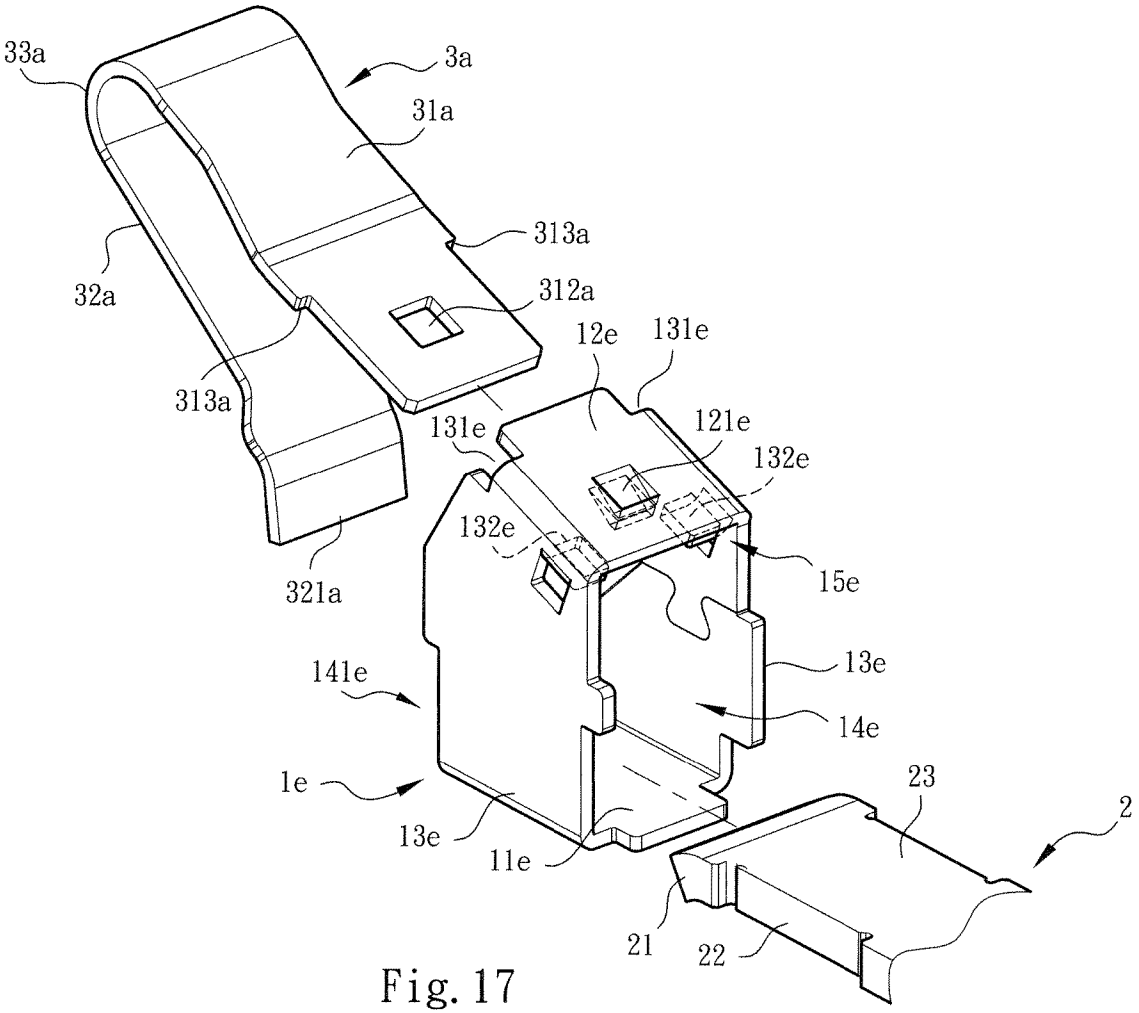
FIG. 17 is a perspective exploded view of a sixth embodiment of the present invention.
Figure 19:
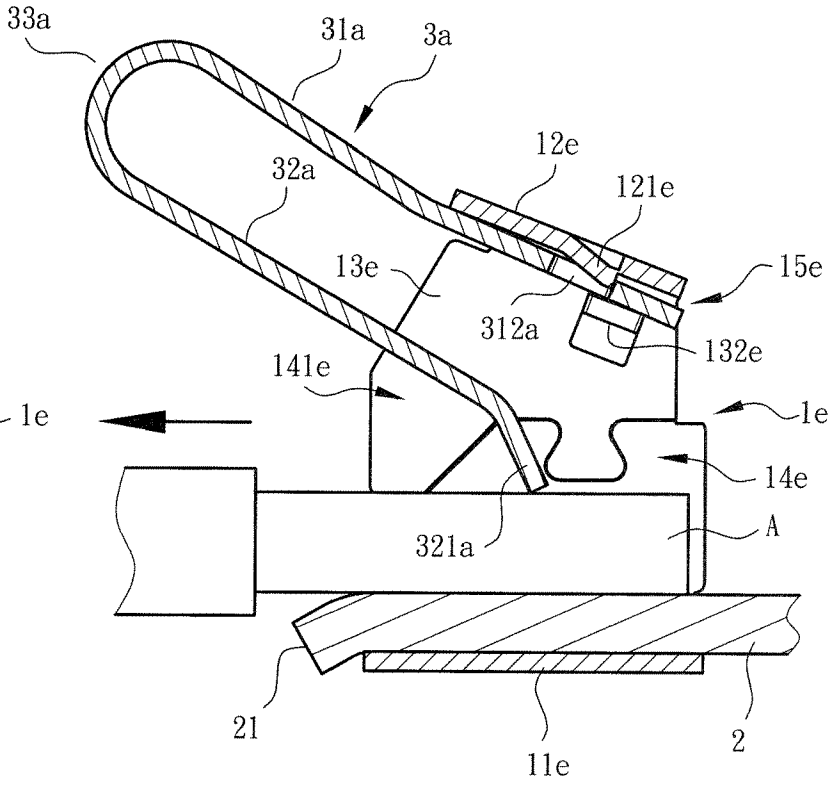
FIG. 19 is a sectional view according to FIG. 18, showing that the external conductive wire is fastened by the metal leaf spring and hindered from being extracted out of the terminal.
Figure 18:
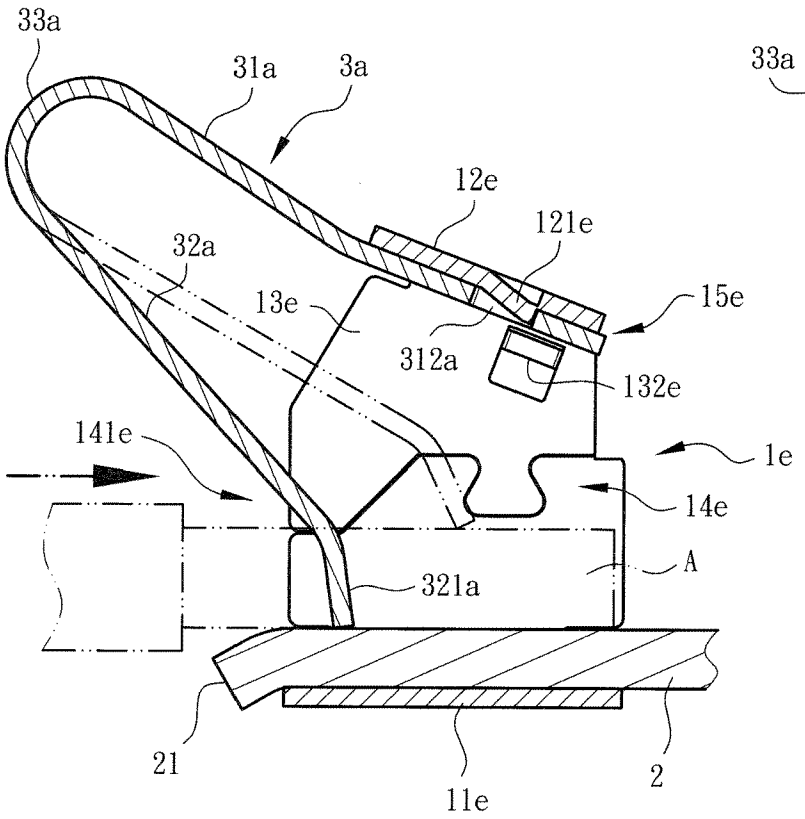
FIG. 18 is an operational sectional view of the sixth embodiment of the present invention, showing that the external conductive wire is plugged into the terminal to push the metal leaf spring.
Figure 20:
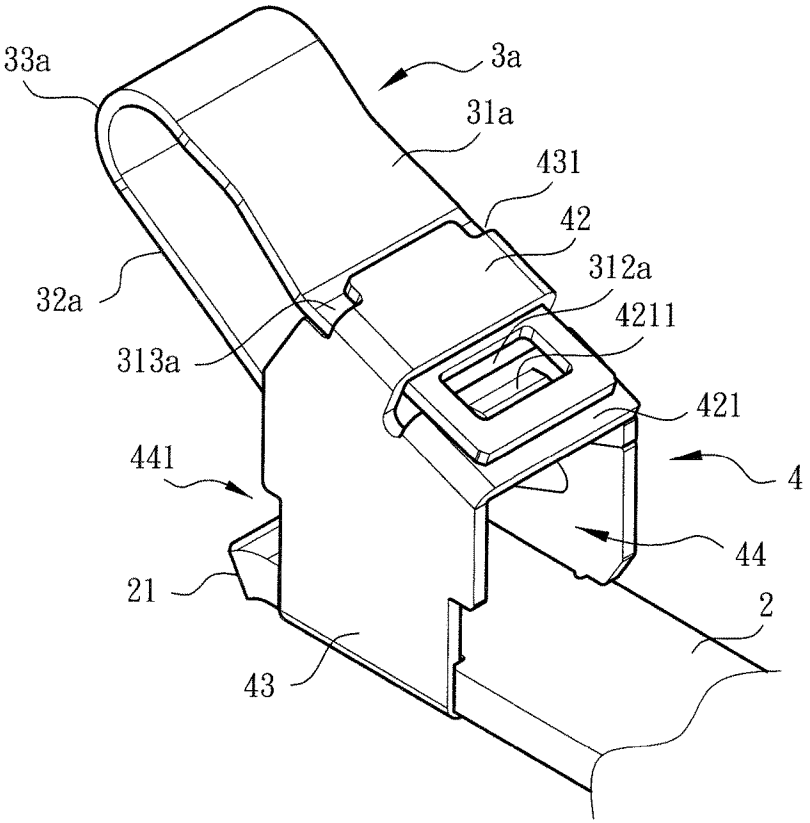
FIG. 20 is a perspective assembled view of a seventh embodiment of the present invention.
Figure 21:
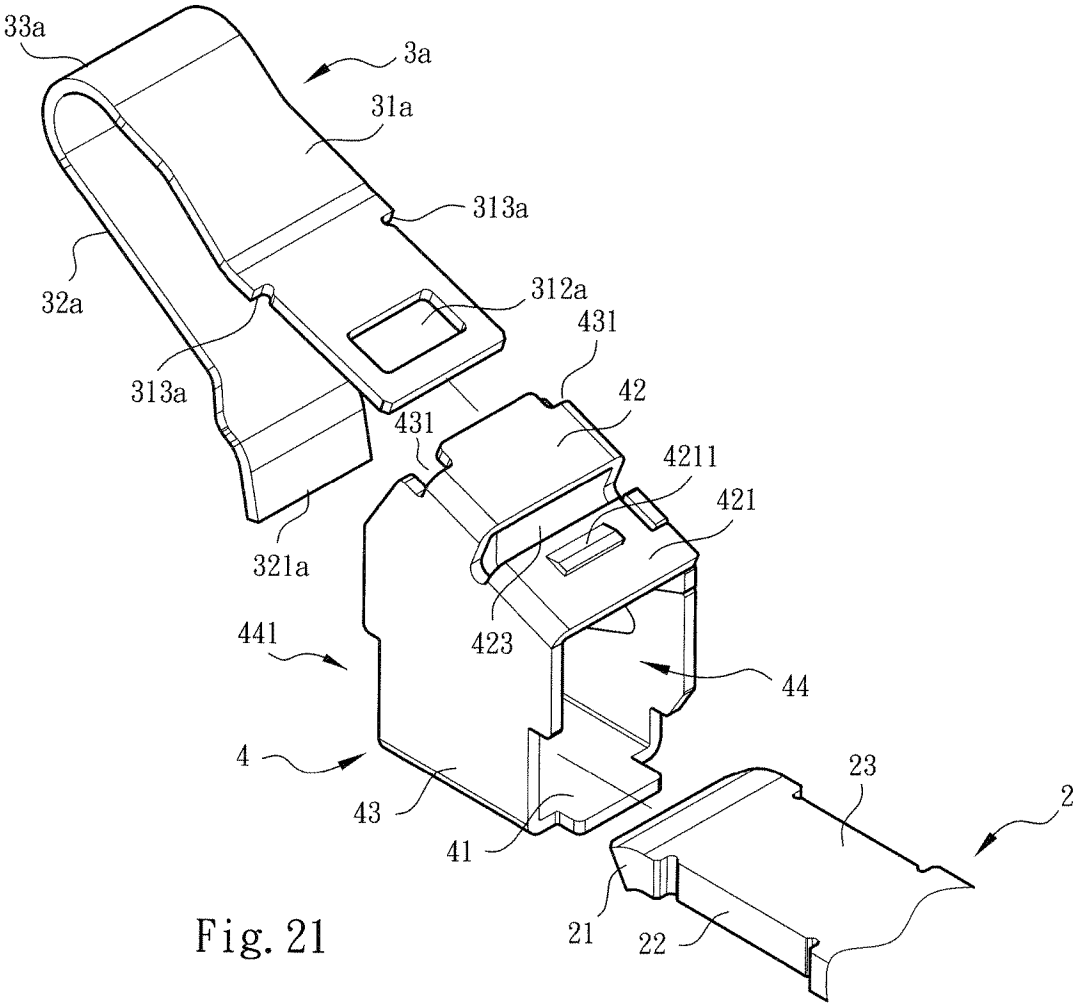
FIG. 21 is a perspective exploded view of the seventh embodiment of the present invention.
Figure 23:
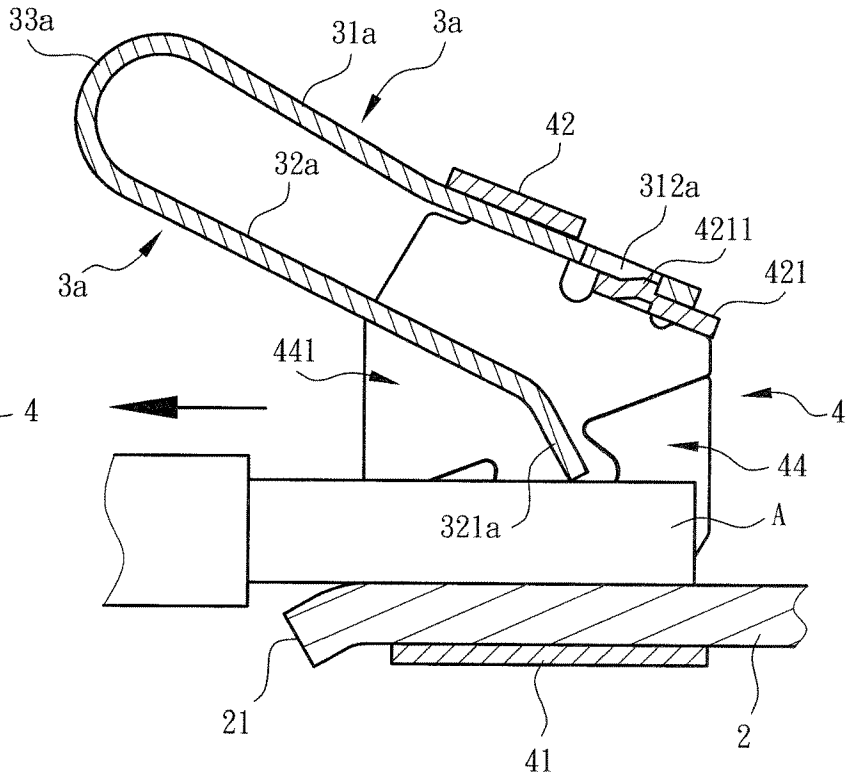
FIG. 23 is a sectional view according to FIG. 22, showing that the external conductive wire is fastened by the metal leaf spring and hindered from being extracted out of the terminal.
Figure 22:
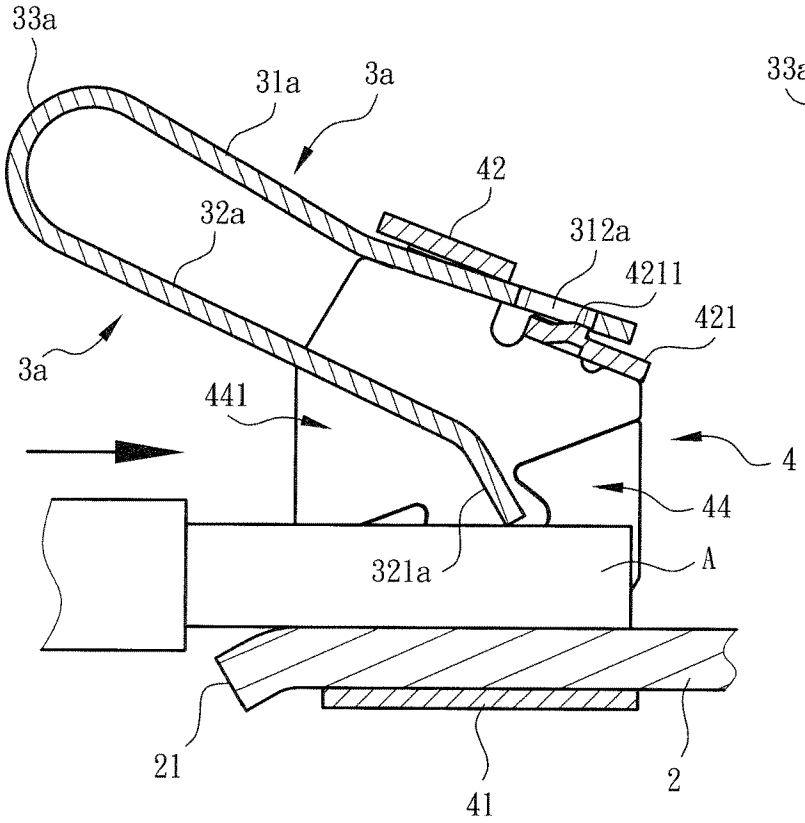
FIG. 22 is an operational sectional view of the seventh embodiment of the present invention, showing that the external conductive wire is plugged into the terminal to push the metal leaf spring.
Figure 24:
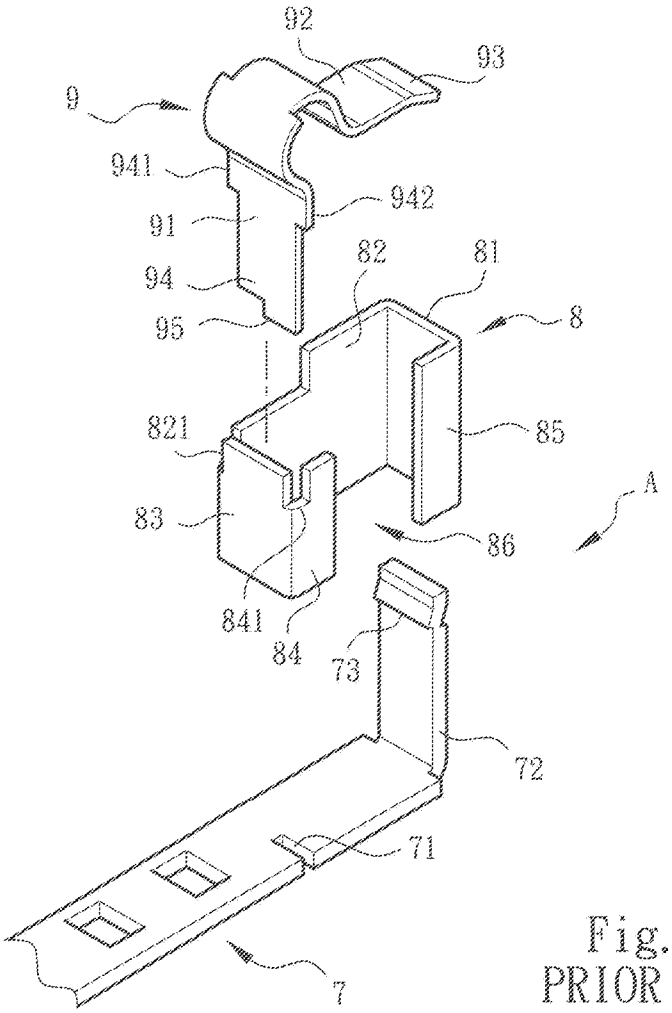
Fig. 24 PRIOR ART
FIG. 24 is a perspective exploded view of a conventional rail terminal.
Figure 26:
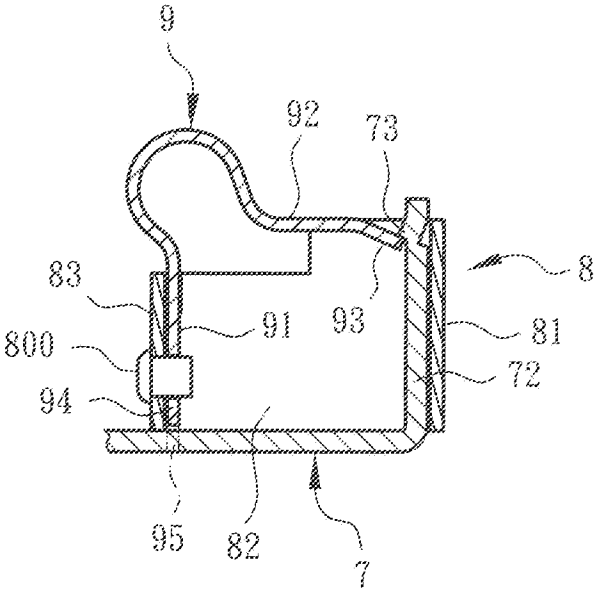
Fig. 26 PRIOR ART
FIG. 26 is a side sectional view of the conventional rail terminal according to FIG. 24, showing that the metal leaf spring and the protection member are connected by means of a fixing member.
Figure 25:
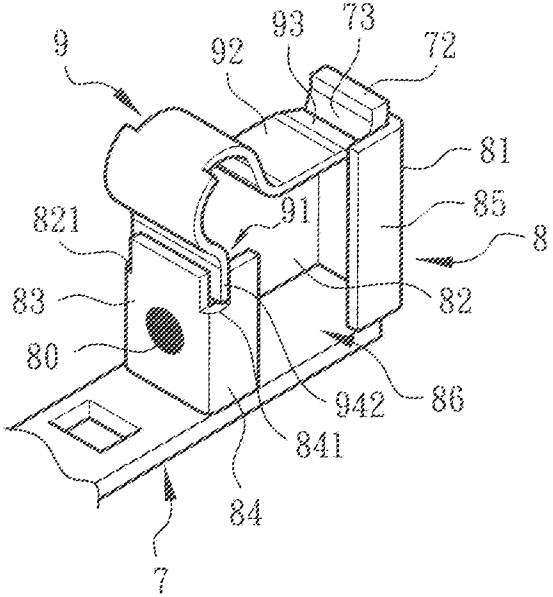
Fig. 25 PRIOR ART
FIG. 25 is a perspective assembled view of the conventional rail terminal according to FIG. 24, showing that the metal leaf spring and the protection member are connected by means of welding.

Please now refer to FIGS. 17 to 19. According to a sixth embodiment, the rail terminal assembling structure of the present invention includes a protection member 1*e* and a conductive plate 2 and metal leaf spring 3*a* identical to the conductive plate and metal leaf spring of the second embodiment. The protection member 1*e* has a contact side section 11*e* and a connection side section 12*e* opposite to each other. Two lateral sections 13*e* are respectively disposed on two sides of the connection side section 12*e*. The lateral sections 13*e* extend from the two sides of the connection side section 12*e* to connect with two sides of the contact side section 11*e* so as to define an assembling passage 14*e* passing through the protection member 1*e*. One end of the assembling passage 14*e* is a wire inlet 141*e*. A first locating section 131*e*, (such as a lateral notch) is formed at the junction between the connection side section 12*e* and each of the two lateral sections 13*e*. In addition, two second locating sections 132*e* are disposed at one end of the protection member 1*e* distal from the first locating sections 131*e* (the lateral notch). Moreover, an elastic locating section 121*e* is disposed on the connection side section 12*e*. The elastic locating section 121*e* protrudes toward the assembling passage 14*e*.

In a preferred embodiment, the second locating sections 132*e* are two lateral stop sections respectively disposed on the middles of the lateral sections 13*e*. The lateral stop sections are bent toward the connection side section 12*e*. In addition, a gap 15*e* is reserved between the second locating sections 132*e* (the lateral stop sections) and the connection side section 12*e*.

The conductive plate 2 is securely assembled and connected on the inner surface of the contact side section 11*e* of the protection member 1*e* in the same manner as the first embodiment.

When assembled, after the conductive plate 2 is connected with the protection member 1*e*, the metal leaf spring 3*a* is extended into the assembling passage 14*e* with the first section 31*a* attached to the connection side section 12*e*. The end face of the first section 31*a* is directly passed through the gap 15*e* and the elastic locating section 121*e* (the elastic locating tongue section) is cooperatively extended into the locating hole 312*a*. The two first located sections 313*a* (the lateral protrusion sections) are respectively engaged with the two first locating sections 131*e* (the lateral notches). Accordingly, the first section 31*a* of the metal leaf spring 3*a* is securely connected with the connection side section 12*e* of the protection member 1*e* to locate the metal leaf spring 3*a*. Also, the elastic end section 321*a* of the second section 32*a* of the metal leaf spring 3*a* abuts against the inner face 23 of the conductive plate 2.

In use, the external conductive wire A extends into the assembling passage 14*e* from one side near the first locating section 131*e* (the lateral notch). At this time, the conductive wire A first pushes the second section 32*a* of the metal leaf spring 3*a* to elastically compress and deform the elastic bight section 33*a*. After the conductive wire A passes through the elastic end section 321*a*, under the elastic restoring force of the elastic bight section 33*a*, the elastic end section 321*a* of the second section 32*a* cooperates with the inner face 23 of the conductive plate 2 to together hold the conductive wire A and electrically connect therewith. In the case that the conductive wire A is pulled by an external force, the conductive wire A will drive the second section 32*a* to move in reverse direction. Under such circumstance, the second section 32*a* will gradually move toward the conductive wire A and fasten the conductive wire A to effectively hinder the conductive wire A from being loosened and extracted out.

Please now refer to FIGS. 20 to 23. According to a seventh embodiment, the rail terminal assembling structure of the present invention includes a protection member 4 and a conductive plate 2 and metal leaf spring 3*a* identical to the conductive plate and metal leaf spring of the second embodiment. The protection member 4 has a contact side section 41 and a connection side section 42 opposite to each other. Two lateral sections 43 are respectively disposed on two sides of the connection side section 42. The lateral sections 43 extend from the two sides of the connection side section 42 to connect with two sides of the contact side section 41 so as to define an assembling passage 44 passing through the protection member 4. One end of the assembling passage 44 is a wire inlet 441. A first locating section 431, (such as a lateral notch) is formed at the junction between the connection side section 42 and each of the two lateral sections 43. In addition, a second locating sections 421 is disposed at one end of the protection member 4 distal from the first locating sections 431 (the lateral notch).

In a preferred embodiment, the second locating section 421 is a lateral bottom section connected between the edges of the two lateral sections 43. The lateral bottom section is positioned on the same side as the connection side section 42 and is lower than the connection side section 42. Accordingly, a lower gap 423 with a height difference is formed between the lateral bottom section and the connection side section 42. At least one protruding elastic locating section 4211 is disposed on the second locating section 421 (the lateral bottom section).

The conductive plate 2 is securely assembled and connected on the inner surface of the contact side section 41 of the protection member 4 in the same manner as the first embodiment.

When assembled, after the conductive plate 2 is connected with the protection member 4, the metal leaf spring 3*a* is extended into the assembling passage 44 with the first section 31*a* attached to the connection side section 42. The end face of the first section 31*a* is directly passed through the lower gap 423 and the elastic locating section 4211 is inserted in the locating hole 312*a*. The two first located sections 313*a* (the lateral protrusion sections) are respectively engaged with the two first locating sections 431 (the lateral notches). Accordingly, the first section 31*a* of the metal leaf spring 3*a* is securely connected with the connection side section 42 and the second locating section 421 (the lateral bottom section) of the protection member 4 and to locate the metal leaf spring 3*a*. Also, the elastic end section 321*a* of the second section 32*a* of the metal leaf spring 3*a* abuts against the inner face 23 of the conductive plate 2.

In use, the external conductive wire A extends into the assembling passage 44 from one side near the first locating section 431 (the lateral notch). At this time, the conductive wire A first pushes the second section 32*a* of the metal leaf spring 3*a* to elastically compress and deform the elastic bight section 33*a*. After the conductive wire A passes through the elastic end section 321*a*, under the elastic restoring force of the elastic bight section 33*a*, the elastic end section 321*a* of the second section 32*a* cooperates with the inner face 23 of the conductive plate 2 to together hold the conductive wire A and electrically connect therewith. In the case that the conductive wire A is pulled by an external force, the conductive wire A will drive the second section 32*a* to move in reverse direction. Under such circumstance, the second section 32*a* will gradually move toward the conductive wire A and fasten the conductive wire A to effectively hinder the conductive wire A from being loosened and extracted out.

In conclusion, in the rail terminal assembling structure of the present invention, the protection member and the metal leaf spring can be truly conveniently assembled with each other and more securely located. This improves the shortcoming of the conventional terminal assembling structure that the conductive plate is needed to help in assembling the metal leaf spring with the protection member. Moreover, after the protection member is assembled with the conductive plate, the wire plug-in direction can be adjusted in accordance with the required different angles. (For example, the angle can be changed as shown by the phantom lines of FIG. 1). Therefore, the external conductive wire can be plugged into the terminal by different angles. Accordingly, the rail terminal assembling structure of the present invention is novel, advanced and inventive.

The above embodiments are only used to illustrate the present invention, not intended to limit the scope thereof. Many modifications of the above embodiments can be made without departing from the spirit of the present invention.

What is claimed is:

1. A rail terminal assembling structure comprising:

a protection member composed of a contact side section, a connection side section opposite to the contact side section and two lateral sections disposed between the connection side section and the contact side section, two lateral stop sections are respectively disposed on the two lateral sections of the protection member near an edge of the second locating section, the contact side section, the connection side section and the lateral sections together defining an assembling passage passing through the protection member, the assembling passage having a wire inlet, the wire inlet having a first locating section and a second locating section disposed at one end of the protection member distal from the first locating section, the second locating section being a stop plate bent from an edge of the connection side section toward the assembling passage, the stop plate having a middle portion formed with an upward protruding elastic tongue section obliquely protruding toward the connection side section, a gap being disposed between the upward protruding elastic tongue section and the connection side section, each of the lateral stop sections being bent toward the assembling passage, the two lateral stop sections respectively abutting against two lateral outer sides of the stop plate;

a conductive plate, an end section of the conductive plate extending into the assembling passage of the protection member and securely attaching to an inner surface of the contact side section; and a metal leaf spring having a first section, a second section and an elastic bight section connected between the first and second sections, the stop plate serving to stop a tail end of the first section of the metal leaf spring, the tail end of the first section of the metal leaf spring being directly inserted in the gap and being located therein, the metal leaf spring being a substantially U-shaped member, a first located section being disposed on the first section of the metal leaf spring near the elastic bight section, in addition, a second located section being disposed on the first section in a position corresponding to the second locating section for cooperatively and securely connecting with the second locating section, whereby the first section of the metal leaf spring can extend into the assembling passage in attachment to the connection side section with the first located section securely assembled with the first locating section and the second located section securely assembled with the second locating section, the metal leaf spring and the protection member themselves having the ability of securely assembling with each other, the second section of the metal leaf spring extending toward the contact side section to press an end section of the conductive plate that extends into the assembling passage.

2. The rail terminal assembling structure as claimed in claim 1, wherein the first locating section is lateral notches disposed at a junction between the connection side section and each of the two lateral sections, the first located section being lateral protrusion sections disposed on the metal leaf spring corresponding to the lateral notches.

3. The rail terminal assembling structure as claimed in claim 2, wherein the second locating section is at least one protruding elastic locating section disposed on the connection side section of the protection member, the second located section being a locating hole formed on the first section of the metal leaf spring corresponding to the elastic locating section.

4. The rail terminal assembling structure as claimed in claim 2, wherein the lateral stop sections are respectively disposed on an edge of the two lateral sections of the protection member.

5. The rail terminal assembling structure as claimed in claim 2, wherein the second locating section is a lateral bottom section connected between edges of the two lateral sections, the lateral bottom section being positioned on the same side as the connection side section and lower than the connection side section, whereby a lower gap with a height difference is formed between the lateral bottom section and the connection side section, at least one protruding elastic locating section being disposed on the lateral bottom section, a locating hole being formed on the first section of the metal leaf spring corresponding to the elastic locating section, whereby after the first section is passed through the lower gap, the elastic locating section is inserted in the locating hole so that the first section of the metal leaf spring is securely connected with the connection side section and the lateral bottom section.

6. The rail terminal assembling structure as claimed in claim 2, wherein the conductive plate is respectively formed with lateral recesses near at least one lateral side of two end sections, the lateral recesses being fittable with a portion of at least one lateral section of the protection member in adjacency to the contact side section and tightly connected therewith, whereby the protection member is located and hindered from moving in an axial direction of the conductive plate.

7. The rail terminal assembling structure as claimed in claim 2, wherein an end face of the second section of the metal leaf spring is formed with an elastic end section arched and bent toward the contact side section.

8. The rail terminal assembling structure as claimed in claim 7, wherein the conductive plate has at least two end sections, the end sections being respectively bent to extend in different directions, each end section being attached to a respective protection member, whereby the wire inlet of each of the protection members attached to the conductive plate are correspondingly directed in the different directions of the end sections of the conductive plate.

9. The rail terminal assembling structure as claimed in claim 2, wherein the conductive plate has at least two end sections, the end sections being respectively bent to extend in different directions, each end section being attached to a respective protection member, whereby the wire inlet of each of the protection members attached to the conductive plate are correspondingly directed in the different directions of the end sections of the conductive plate.

10. The rail terminal assembling structure as claimed in claim 1, wherein the second locating section is at least one protruding elastic locating section disposed on the connection side section of the protection member, the second located section being a locating hole formed on the first section of the metal leaf spring corresponding to the elastic locating section.

11. The rail terminal assembling structure as claimed in claim 1, wherein the stop plate is formed with a perforation on one side near the connection side section, the tail end of the first section of the metal leaf spring being formed with an end protrusion section corresponding to the perforation, the end protrusion section being inserted in the perforation and located therein.

12. The rail terminal assembling structure as claimed in claim 1, wherein the conductive plate is respectively formed with lateral recesses near at least one lateral side of two end sections, the lateral recesses being fittable with a portion of at least one lateral section of the protection member in adjacency to the contact side section and tightly connected therewith, whereby the protection member is located and hindered from moving in an axial direction of the conductive plate.

13. The rail terminal assembling structure as claimed in claim 1, wherein an end face of the second section of the metal leaf spring is formed with an elastic end section arched and bent toward the contact side section.

14. The rail terminal assembling structure as claimed in claim 13, wherein the conductive plate has at least two end sections, the end sections being respectively bent to extend in different directions, each end section being attached to a respective protection member, whereby the wire inlet of each of the protection members attached to the conductive plate are correspondingly directed in the different directions of the end sections of the conductive plate.

15. The rail terminal assembling structure as claimed in claim 1, wherein the conductive plate has at least two end sections, the end sections being respectively bent to extend in different directions, each end section being attached to a respective protection member, whereby the wire inlet of each of the protection members attached to the conductive plate are correspondingly directed in the different directions of the end sections of the conductive plate.

16. A rail terminal assembling structure comprising:

a protection member composed of a contact side section, a connection side section opposite to the contact side section and two lateral sections disposed between the connection side section and the contact side section, the contact side section, the connection side section and the lateral sections together defining an assembling passage passing through the protection member, the assembling passage having a wire inlet, the wire inlet having a first locating section and a second locating section disposed at one end of the protection member distal from the first locating section, the second locating section being defined by two lateral stop sections respectively disposed on the two lateral sections of the protection member, the lateral stop sections being bent toward the assembling passage, a gap is disposed between the lateral stop sections and the connection side section;

a conductive plate having an end section extending into the assembling passage of the protection member and securely attaching to an inner surface of the contact side section; and a metal leaf spring having a first section, a second section and an elastic bight section connected between the first and second sections, whereby the metal leaf spring is a substantially U-shaped member, a first located section being disposed on the first section of the metal leaf spring near the elastic bight section, in addition, a second located section being disposed on the first section in a position corresponding to the second locating section for cooperatively and securely connecting with the second locating section, whereby the first section of the metal leaf spring can extend into the assembling passage in attachment to the connection side section with the first located section securely assembled with the first locating section and the second located section securely assembled with the second locating section, the metal leaf spring and the protection member themselves having the ability of securely assembling with each other, a tail end of the first section of the metal leaf spring being directly passed through the gap and located therein, the second section of the metal leaf spring extending toward the contact side section to press an end section of the conductive plate that extends into the assembling passage.

17. The rail terminal assembling structure as claimed in claim 16, wherein the lateral stop sections are respectively disposed on an edge of the two lateral sections of the protection member.

18. A rail terminal assembling structure comprising:

a protection member composed of a contact side section, a connection side section opposite to the contact side section and two lateral sections disposed between the connection side section and the contact side section, the contact side section, the connection side section and the lateral sections together defining an assembling passage passing through the protection member, the assembling passage having a wire inlet, the wire inlet having a first locating section and a second locating section disposed at one end of the protection member distal from the first locating section, the second locating section is a lateral bottom section connected between edges of the two lateral sections, the lateral bottom section being positioned on a same side of the protection member as the connection side section and lower than the connection side section, whereby a gap is formed between the lateral bottom section and the connection side section by a height difference therebetween, at least one protruding elastic locating section being disposed on the lateral bottom section;

a conductive plate having an end section of the conductive plate extending into the assembling passage of the protection member and securely attaching to an inner surface of the contact side section; and a metal leaf spring having a first section, a second section and an elastic bight section connected between the first and second sections, whereby the metal leaf spring is a substantially U-shaped member, a first located section being disposed on the first section of the metal leaf spring near the elastic bight section, in addition, a second located section being disposed on the first section in a position corresponding to the second locating section for cooperatively and securely connecting with the second locating section, whereby the first section of the metal leaf spring can extend into the assembling passage in attachment to the connection side section with the first located section securely assembled with the first locating section and the second located section securely assembled with the second locating section, the metal leaf spring and the protection member themselves having the ability of securely assembling with each other, the second section of the metal leaf spring extending toward the contact side section to press an end section of the conductive plate that extends into the assembling passage, a locating hole being formed on the first section of the metal leaf spring corresponding to the elastic locating section, whereby after the first section is passed through the gap, the elastic locating section is inserted in the locating hole so that the first section of the metal leaf spring is securely connected with the connection side section and the lateral bottom section.

* * * * *